US010096439B2

(12) United States Patent
Wakuda

(10) Patent No.: US 10,096,439 B2
(45) Date of Patent: Oct. 9, 2018

(54) SPRING PLATE, PUSH SWITCH INCLUDING SPRING PLATE, AND ELECTRONIC DEVICE INCLUDING PUSH SWITCH

(71) Applicants: CITIZEN ELECTRONICS CO., LTD., Yamanashi-ken (JP); CITIZEN WATCH CO., LTD., Tokyo (JP)

(72) Inventor: Ryo Wakuda, Kofu (JP)

(73) Assignees: CITIZEN ELECTRONICS CO., LTD., Yamanashi-Ken (JP); CITIZEN WATCH CO., LTD., Tokyo (JP)

( * ) Notice: Subject to any disclaimer, the term of this patent is extended or adjusted under 35 U.S.C. 154(b) by 0 days.

(21) Appl. No.: 15/642,615

(22) Filed: Jul. 6, 2017

(65) Prior Publication Data

US 2018/0068810 A1 Mar. 8, 2018

Related U.S. Application Data

(60) Provisional application No. 62/382,866, filed on Sep. 2, 2016.

(51) Int. Cl.

| | |
|---|---|
| ***H01H 13/48*** | (2006.01) |
| ***H01H 13/50*** | (2006.01) |
| ***H01H 13/10*** | (2006.01) |
| ***H01H 13/14*** | (2006.01) |

(52) U.S. Cl.

CPC ..... *H01H 13/50* (2013.01); *H01H 13/10* (2013.01); *H01H 13/14* (2013.01); *H01H 13/48* (2013.01); *H01H 2215/004* (2013.01); *H01H 2215/036* (2013.01)

(58) Field of Classification Search

CPC ..... H01H 11/06; H01H 13/14; H01H 13/48; H01H 13/703; H01H 13/702; H01H 2215/004; H01H 2215/036

USPC ..... 200/406, 513

See application file for complete search history.

(56) References Cited

U.S. PATENT DOCUMENTS

| | | | | |
|---|---|---|---|---|
| 3,941,964 | A * | 3/1976 | Yoder | H01H 13/7006 200/275 |
| 2004/0256211 | A1* | 12/2004 | Chen | H01H 13/36 200/406 |
| 2008/0277251 | A1* | 11/2008 | Tatman | H01H 13/48 200/17 B |
| 2018/0068810 | A1* | 3/2018 | Wakuda | H01H 13/50 |

FOREIGN PATENT DOCUMENTS

| | | |
|---|---|---|
| JP | 7-25533 | 5/1995 |
| JP | 3112330 | 8/2005 |
| JP | 2005-340126 | 12/2005 |

* cited by examiner

*Primary Examiner* — Vanessa Girardi

(74) *Attorney, Agent, or Firm* — Wenderoth Lind & Ponack, L.L.P.

(57) ABSTRACT

In a first aspect of the present disclosure, a spring plate includes a central portion; a first leg portion projecting outward from an edge of the central portion; and a second leg portion projecting outward from the edge of the central portion. The first leg portion includes a hollow portion that is positioned within an outline of the first leg portion in a top plan view, and the second leg portion includes a hollow portion that is positioned within an outline of the second leg portion in a top plan view.

4 Claims, 22 Drawing Sheets

FIG. 3A

FIG. 3B

SPRING PLATE, PUSH SWITCH INCLUDING SPRING PLATE, AND ELECTRONIC DEVICE INCLUDING PUSH SWITCH

CROSS-REFERENCE TO RELATED APPLICATION

This application is a new U.S. patent application that claims benefit of U.S. provisional application No. 62/382,866 filed on Sep. 2, 2016, the disclosures of which are incorporated herein by reference in its entirety.

BACKGROUND OF THE INVENTION

Field of the Invention

The subject matter herein generally relates to a spring plate, a push switch including the spring plate, and relates to an electronic device including the push switch.

Various electronic devices include push switches. Various electronic devices may be computers, portable communication devices, wearable devices, and game consoles, on-vehicle devices for example.

Description of the Related Art

It is open to the public that a conventional spring plate including at least two arc shaped protrusion each protruding toward a circular circuit that is positioned under the center of the spring plate (For reference, see Japanese Utility Model Publication No. 3112330).

Also, it is open to the public that a conventional spring plate including a movable contact part that is connected to a connecting portion with a slit on either side of the movable contact part and also including a protruding portion that can be a contact portion (For reference, see Japanese Unexamined Patent Application Publication No. 2005-340126).

Furthermore, it is open to the public that a conventional spring plate includes a dome shape bulging in a first direction and a protrusion protruding in a second direction that is opposite to the first direction (For reference, see Japanese Utility Model Publication No. H7-25533).

SUMMARY OF THE INVENTION

In a first aspect of the present inventive subject matter, a spring plate includes a central portion; a first leg portion projecting outward from an edge of the central portion; and a second leg portion projecting outward from the edge of the central portion. The first leg portion includes a hollow portion that is positioned within an outline of the first leg portion in a top plan view, and the second leg portion includes a hollow portion that is positioned within an outline of the second leg portion in a top plan view.

In a second aspect of the present inventive subject matter, a spring plate includes a central portion; a first leg portion projecting outward from an edge of the central portion; a second leg portion projecting outward from the edge of the central portion; a third leg portion projecting outward from the edge of the central portion; and a fourth leg portion projecting outward from the edge of the central portion. The first leg portion, the second leg portion, the third leg portion and the fourth leg portion are positioned around the central portion at regular intervals. The first leg portion includes a hollow portion that is positioned within an outline of the first leg portion in a top plan view. The second leg portion includes a hollow portion that is positioned within an outline of the second leg portion in a top plan view. The third leg portion includes a hollow portion that is positioned within an outline of the third leg portion in a top plan view. The fourth leg portion includes a hollow portion that is positioned within an outline of the fourth leg portion in a top plan view.

In a third aspect of the present inventive subject matter, a push switch includes a spring plate including a central portion, a leg portion projecting outward from an edge of the central portion. The leg portion includes a hollow portion that is positioned within an outline of the leg portion in a top plan view. The push switch further includes a first electrode arranged below the central portion of the spring plate; and a second electrode on that the hollow portion of the leg portion of the spring plate is arranged.

In a fourth aspect of the present inventive subject matter, a push switch includes a spring plate including a central portion, a leg portion projecting outward from an edge of the central portion. The leg portion includes a hollow portion that is positioned within an outline of the leg portion in a top plan view. The push switch further includes a substrate including a first surface, a second surface that is positioned opposite to the first surface, a peripheral side surface between the first surface and the second surface; and a first electrode arranged on the first surface of the substrate and a second electrode arranged on the first surface of the substrate. The hollow portion of the leg portion of the spring plate includes a bottom including a first surface and a second surface opposite to the first surface of the bottom. The hollow portion further includes a surrounding surface that surrounds the first surface of the bottom of the hollow portion, and the second surface of the bottom of the hollow portion being arranged on the second electrode arranged on the first surface of the substrate.

BRIEF DESCRIPTION OF THE DRAWING

FIG. 1B is also an enlarged view of a cross-sectional view of a leg portion in the first direction.

FIG. 1C is a cross-sectional enlarged view of the leg portion in the second direction that is perpendicular to the first direction.

FIG. 9C (b) is a perspective view of a frame according to the eleventh embodiment of the subject matter.

FIG. 9C (c) is a perspective view of the frame with the spring plate is set.

FIG. 13D (b) is a perspective view of a frame according to the fifteenth embodiment of the subject matter.

FIG. 13D (c) is a perspective view of the frame with the spring plate is set.

DETAILED DESCRIPTION OF EMBODIMENTS

As used herein, the term "and/or" includes any and all combinations of one or more of the associated listed items.

The terminology used herein is for the purpose of describing particular embodiments only and is not intended to be limiting of the subject matter. As used herein, the singular forms "a", "an" and "the" are intended to include the plural forms as well, unless the context clearly indicates otherwise.

As illustrated in the figures submitted herewith, some sizes of structures or portions may be exaggerated relative to other structures or portions for illustrative purposes.

Relative terms such as "below" or "above" or "upper" or "lower" or "top" or "bottom" may be used herein to describe a relationship of one element, layer or region to another element, layer or region as illustrated in the figures. It will be understood that these terms are intended to encompass different orientations of a device in addition to the orientation depicted in the figures.

In a first aspect of the subject matter, a spring plate includes a central portion, and a leg portion projecting outward from an edge of the central portion. The leg portion of the spring plate includes a hollow portion that is positioned within an outline of the leg portion in a top plan view.

In a second aspect of the subject matter, a spring plate includes a central portion, a first leg portion projecting outward from an edge of the central portion, and a second leg portion projecting outward from the edge of the central portion. The first leg portion includes a hollow portion that is positioned within an outline of the first leg portion in a top plan view. The second leg portion includes a hollow portion that is positioned within an outline of the second leg portion in a top plan view.

Also, it is suggested that the spring plate may further include a first support leg portion projecting outward from the edge of the central portion and being positioned between the first leg portion and the second leg portion, and a second support leg portion projecting outward from the edge of the central portion and being positioned opposite to the first support leg portion.

Embodiments of the subject matter now will be described more hereinafter with reference to the accompanying drawings, in which embodiments of the subject matter are shown. This subject matter may, however, be embodied in many different forms and should not be construed as limited to the embodiments set forth herein. Rather, these embodiments are provided so that this disclosure will be thorough and complete, and will fully convey the scope of the subject matter to those skilled in the art.

Figure 1A:
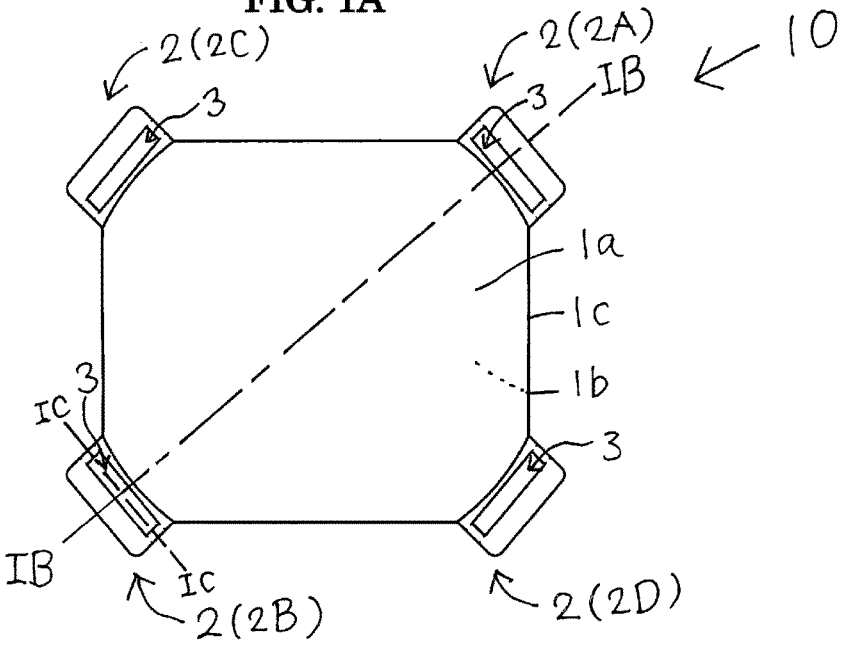
FIG. 1A is a top plan view of a spring plate according to a first embodiment of the subject matter.
Figure 1B:
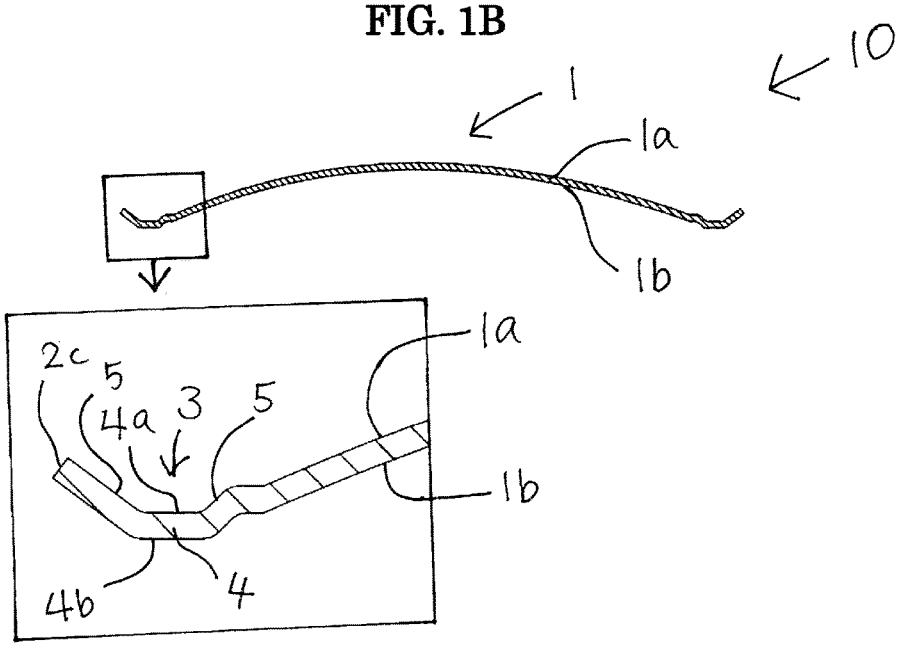
FIG. 1B is a cross-sectional view of the spring plate, taken along a dot and dash line IB (a first direction) of FIG. 1A.
Figure 1C:
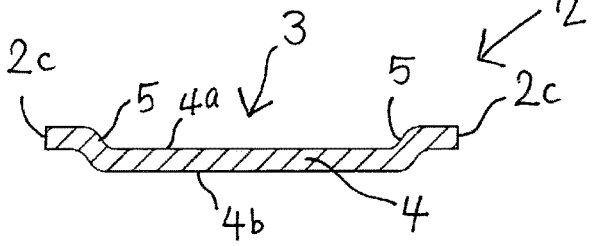
FIG. 1C is a cross-sectional view of the spring plate, taken along a dot and dash line IC (a second direction) of FIG. 1A.

A spring plate 10 according to a first embodiment of the subject matter will be described with reference to FIGS. 1A to 1C.

The spring plate 10 includes a central portion 1, and a leg portion 2 projecting outward from an edge 1*c* of the central portion 1. The leg portion 2 of the spring plate 10 includes a hollow portion 3 that is positioned within an outline of the leg portion 2 in a top plan view.

With this configuration, a lower surface 4*b* of the hollow portion 3 of the spring plate 10 is positioned at a lowest position in the spring plate 10.

The hollow portion 3 of the leg portion 2 includes a bottom 4 and a surrounding surface 5 that surrounds the bottom 4. The lower surface 4*b* of the hollow portion 3 is the lower surface 4*b* of the bottom 4 of the hollow portion 3. The central portion 1 of the spring plate 10 includes a convex shape.

When the spring plate 10 is used in a push switch, the convex shape of the spring plate 10 may be arranged over a first electrode and the lower surface 4*b* of the bottom 4 of the hollow portion 3 of the leg portion 2 of the spring plate 10 may be arranged on a second electrode.

When the push switch is pressed down, the convex shape of the central portion 1 of the spring plate 10 will be pressed out of the convex shape or crushed on the first electrode, and the lower surface 4*b* of the hollow portion 3 will slide out on the second electrode. The spring plate 10 may be made of metal.

Accordingly, the first electrode and the second electrode are electrically connected by the spring plate 10, and the push switch acts as a switch.

The spring plate 10 may be made of stainless, for example. The spring plate 10 may be made of alloy steel, nickel alloy, aluminum alloy, and/or titanium, for example.

The shape of the hollow portion 3 of the leg portion 2 of the spring plate 10 according to an embodiment of the subject matter may less impair a surface quality of the second electrode, compared to a shape including and/or connected to a part of a cross section of a spring plate, for example.

The spring plate may be cut out from a metal plate. The outline of the spring plate including the leg portion may be a cross section of the spring plate that is made of metal. The cross section of the spring plate tends to impair a surface quality of an electrode on which the spring plate is arranged. Since the hollow portion of the leg portion of the spring plate is positioned within the outline of the spring plate, the lower surface of the bottom of the hollow portion on the second electrode is free from a cross section of the spring plate.

The hollow portion 3 of the leg portion 2 of the spring plate 10 may include a cup shape.

For more details, a spring plate 10 includes a central portion 1, a first leg portion 2 (2A) projecting outward from an edge 1*c* of the central portion 1. The spring plate 10 further includes a second leg portion 2 (2B) projecting outward from the edge 1*c* of the central portion 1. The first leg portion 2 (2A) includes a hollow portion 3 that is positioned within an outline of the first leg portion 2 (2A) in a top plan view. The second leg portion 2 (2B) includes a hollow portion 3 that is positioned within an outline of the second leg portion 2 (2B).

The first leg portion 2 (2A) may be positioned with a space from the second leg portion 2 (2B). The first leg portion 2 (2A) may be positioned opposite to the second leg portion 2 (2B).

The spring plate 10 may further include a third leg portion 2 (2C) projecting outward from the edge 1*c* of the central portion 1. The spring plate 10 may further include a fourth leg portion 2 (2D) projecting outward from the edge 1*c* of the central portion 1. The third leg portion 2 (2C) includes a hollow portion 3 that is positioned within an outline of the third leg portion 2 (2C) in a top plan view. The fourth leg portion 2 (2D) includes a hollow portion 3 that is positioned within an outline of the fourth leg portion 2 (2D) in a top plan view.

Figure 2A:
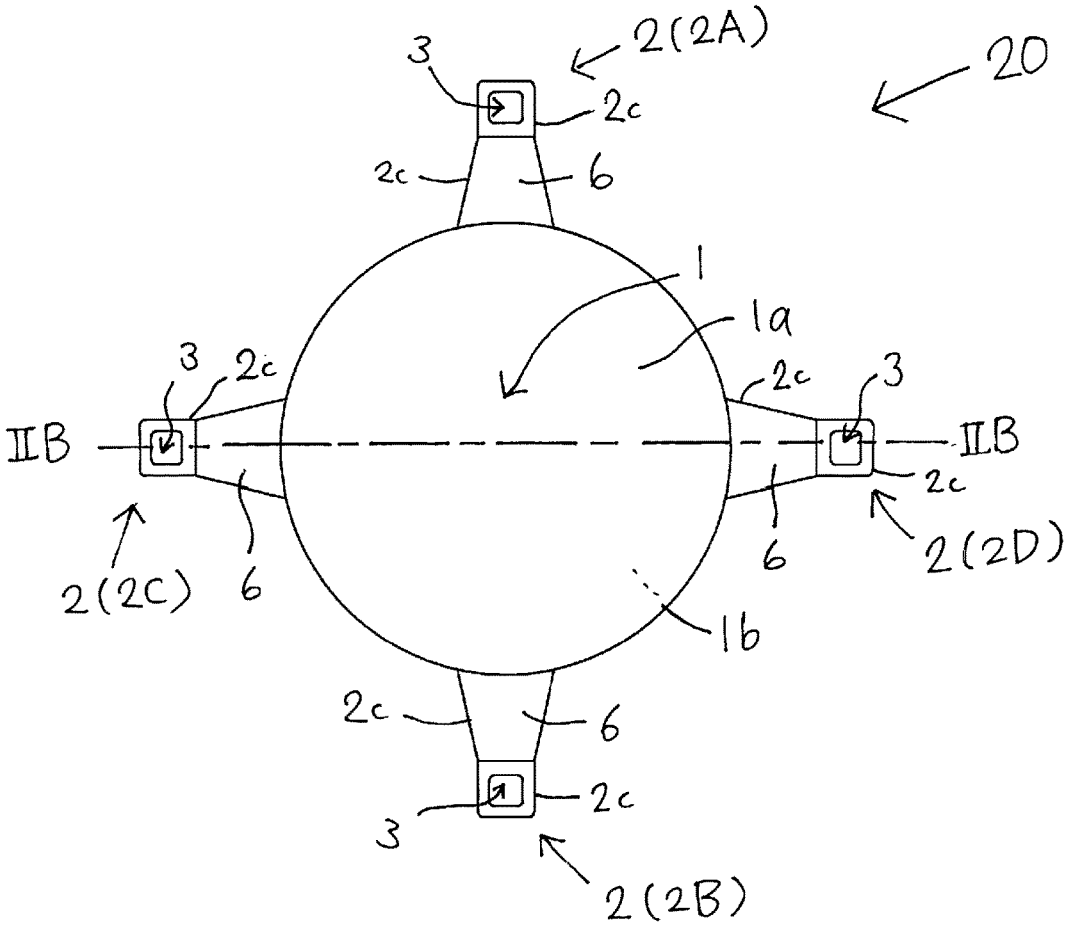
FIG. 2A is a top plan view of a spring plate according to a second embodiment of the subject matter.
Figure 2B:
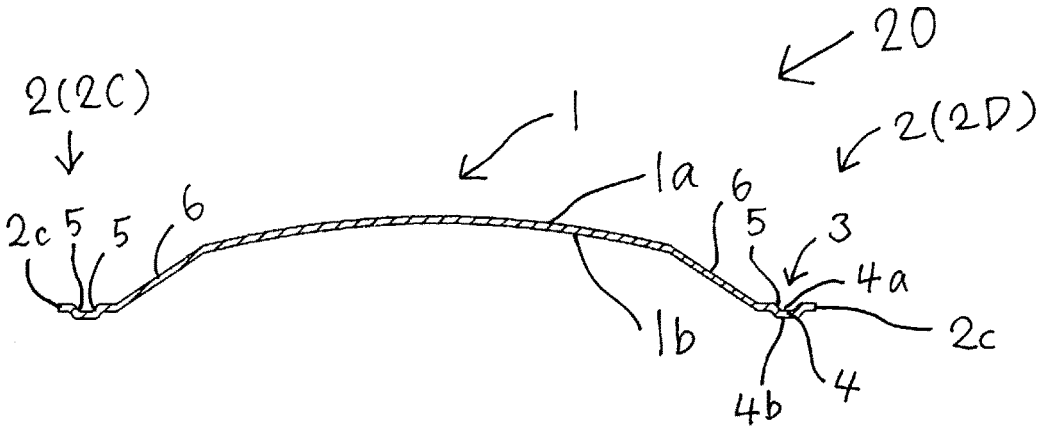
FIG. 2B is a cross-sectional view of the spring plate, taken along a dot and dash line IIB of FIG. 2A.

A spring plate 20 according to a second embodiment of the subject matter will be described with reference to FIGS. 2A and 2B.

The spring plate 20 includes four leg portions that are a first leg portion 2 (2A), a second leg portion 2 (2B), a third leg portion 2 (2C) and a fourth leg portion 2 (2D). In this embodiment, a hollow portion 3 in each leg portion 2 is positioned away with a distance from the edge 1*c* of the central portion 1. The distance from the edge 1*c* of the central portion 1 to the hollow portion 3 may be longer than a width of the hollow portion 3 in each leg portion 2. If the distance from the edge 1*c* of the central portion 1 to the hollow portion 3 of the leg portion 2 is longer, it is possible to make a switch stroke to an electrode below the central portion 1 of the spring plate 1 longer.

In another embodiment, it is possible to provide a spring plate with three leg portions. A spring plate includes a central portion 1, a first leg portion 2 (2A) projecting outward from an edge 1*c* of the central portion 1, a second leg portion 2 (2B) projecting outward from the edge 1*c* of the central portion 1, a third leg portion 2 (2C) projecting outward from the edge 1*c* of the central portion 1. The first leg portion 2 (2A), the second leg portion 2 (2B) and the third leg portion 2 (2C) may be positioned around the central portion 1 at regular intervals.

The first leg portion 2 (2A) and the second leg portion 2 (2B) may be positioned at an angle of 120 degrees to each other. The second leg portion 2 (2B) and the third leg portion (2C) may be positioned at an angle of 120 degrees to each other. The third leg portion 2 (2C) and the first leg portion (2A) may be positioned at an angle of 120 degrees to each other.

The first leg portion 2 (2A) includes a hollow portion 3 that is positioned within an outline 2*c* of the first leg portion 2 (2A) in a top plan view. The second leg portion 2 (2B) includes a hollow portion 3 that is positioned within an outline 2*c* of the second leg portion 2 (2B) in a top plan view. The third leg portion 2 (2C) includes a hollow portion 3 that is positioned within an outline 2*c* of the third leg portion 2 (2C) in a top plan view.

Figure 3A:
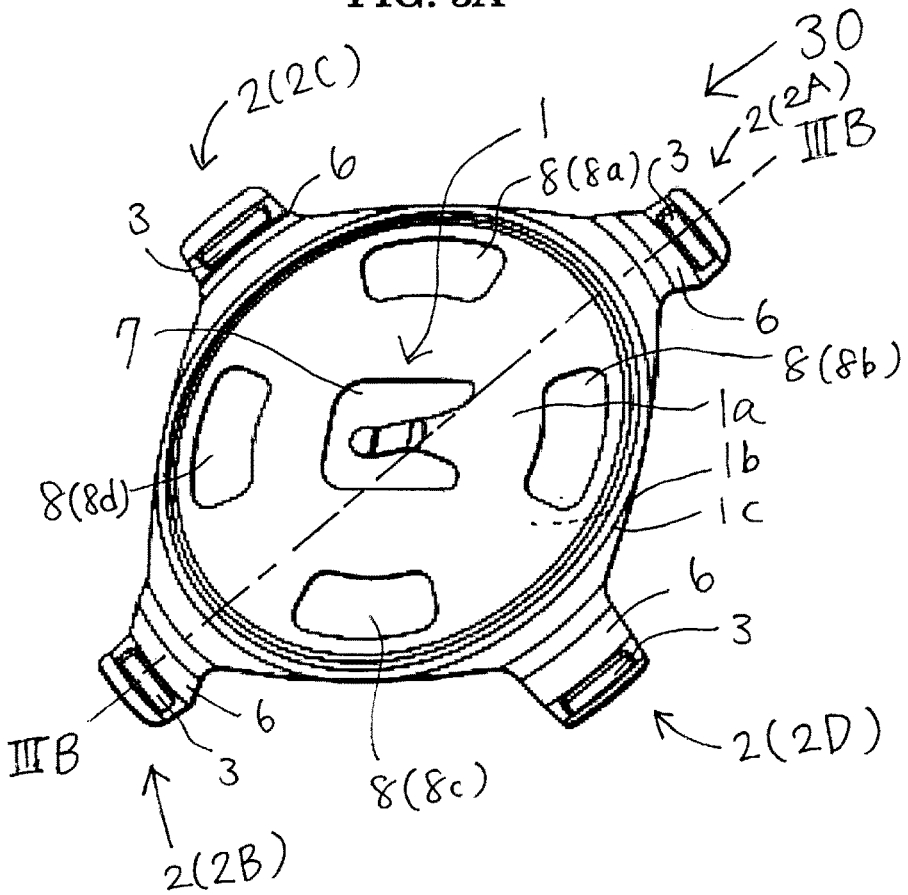
FIG. 3A is a top perspective view of a spring plate according to a third embodiment of the subject matter.
Figure 3B:
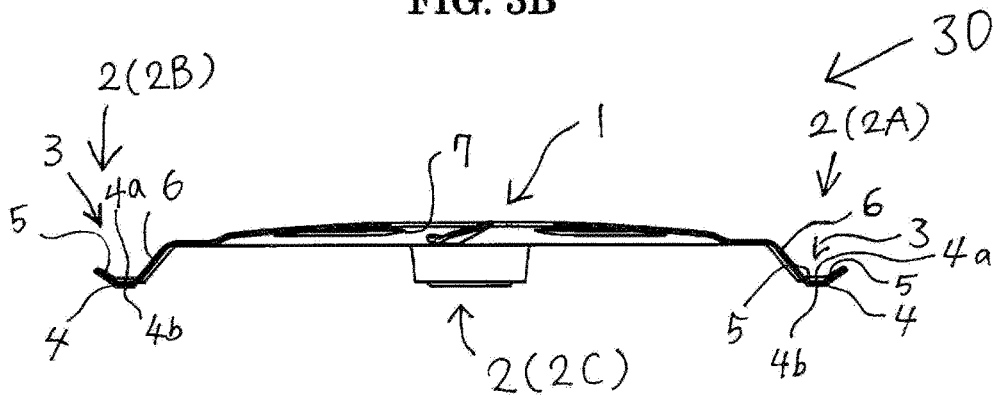
FIG. 3B is a cross-sectional view of the spring plate, taken along a dot and dash line IIIB of FIG. 3A.

A spring plate 30 according to a third embodiment of the subject matter will be described with reference to FIGS. 3A and 3B. An enlarged view of a leg portion according to this embodiment is also as in FIG. 1B.

The spring plate 30 includes a central portion 1, a first leg portion 2 (2A) projecting outward from an edge 1*c* of the central portion 1, a second leg portion 2 (2B) projecting outward from the edge 1*c* of the central portion 1, a third leg portion 2 (2C) projecting outward from the edge 1*c* of the central portion, and a fourth leg portion 2 (2D) projecting outward from the edge 1*c* of the central portion 1. The first leg portion 2 (2A), the second leg portion 2 (2B), the third leg portion 2 (2C) and the fourth leg portion 2 (2D) are positioned around the central portion 1 at regular intervals. The first leg portion 2 (2A) includes a slant portion 6 that is positioned closer to the edge 1*c* of the central portion 1 than the hollow portion 3 of the first leg portion 2 (2A). The second leg portion 2 (2B) includes a slant portion 6 that is positioned closer to the edge of 1*c* of the central portion 1 than the hollow portion 3 of the second leg portion 2 (2B). The third leg portion 2 (2C) includes a slant portion 6 that is positioned closer to the edge 1*c* of the central portion 1 than the hollow portion 3 the third leg portion 2 (2C). The fourth leg portion 2 (2D) includes a slant portion 6 that is positioned closer to the edge 1*c* of the central portion 1 than the hollow portion 3 of the fourth leg portion 2 (2D). If the distance from the edge 1*c* of the central portion 1 to the hollow portion 3 of the leg portion 2 is longer, it is possible to make a switch stroke to an electrode below the central portion 1 of the spring plate 10 longer. Accordingly, the leg portion of the spring plate may include one or more slant portions and/or level surfaces. Such structure may give a user a better click feeling when the push switch is pressed.

The first leg portion 2 (2A) includes a hollow portion 3 that is positioned within an outline 2*c* of the first leg portion 2 (2A) in a top plan view. The second leg portion 2 (2B) includes a hollow portion 3 that is positioned within an outline 2*c* of the second leg portion 2 (2B) in a top plan view. The third leg portion 2 (2C) includes a hollow portion 3 that is positioned within an outline 2*c* of the third leg portion 2 (2C) in a top plan view. The fourth leg portion 2 (2D) includes a hollow portion 3 that is positioned within an outline 2*c* of the fourth leg portion 2 (2D) in a top plan view.

Figure 4A:
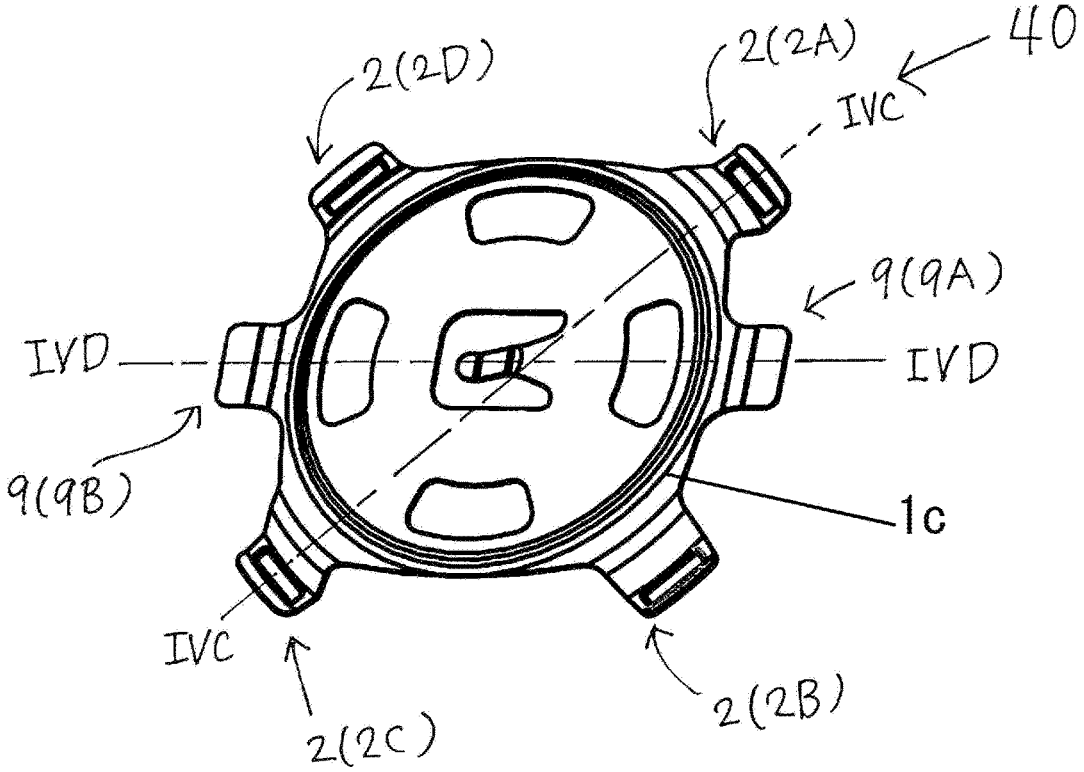
FIG. 4A is a top perspective view of a spring plate according to a fourth embodiment of the subject matter. The spring plate includes two support leg portions.

A spring plate 40 according to a fourth embodiment of the subject matter will be described with reference to FIGS. 4A, 4C, and 4D. And a spring plate 50 according to a fifth embodiment will be described with reference to FIGS. 4B, 4C, and 4D. An enlarged view of a leg portion according to the fourth and fifth embodiments are also as in FIG. 1B.

The spring plate 40 according to the fourth embodiment of the subject matter includes four leg portions 2A to 2D and further includes a first support leg portion 9 (9A) projecting outward from the edge 1*c* of the central portion 1 and a second support leg portion 9 (9B) projecting outward from the edge 1*c* of the central portion 1. The first support leg portion 9 (9A) may be positioned opposite to the second support leg portion 9 (9B).

The spring plate 50 includes four leg portions 2A to 2D and further includes four support leg portions 9A to 9D, a first support leg portion 9 (9A), a second support leg portion 9 (B), a third support leg portion 9 (9C) and a fourth support leg portion 9 (9D). Each support leg portion 9 (9A to 9D) projects outward from the edge 1*c* of the central portion 1. The first support leg portion 9 (9A) may be positioned opposite to the second support leg portion 9 (9B). The third support leg portion 9 (9C) is positioned opposite to the fourth support leg portion 9 (9D).

In the spring plate 40 according to the fourth embodiment of the subject matter, the first support leg portion 9 (9A) is positioned higher than the hollow portion 3 of the first leg portion 2 (2A) when a convex shape of the central portion 1 of the spring plate 40 is arranged upward.

The second support leg portion 9 (9B) is positioned higher than the hollow portion 3 of the fourth leg portion 2 (2D). Since the support leg portions 9 of the spring plate 40 are positioned higher than the hollow portions 3 of the leg portions 2 of the spring plate 40, the spring plate 40 can be supported at the support leg portions 9. This configuration might help position the spring plate 40 when the spring plate 40 is arranged in a push switch.

In the fourth embodiment, the first support leg portion 9 (9A) is positioned between the first leg portion 2 (2A) and the second leg portion 2 (2B). The second support leg portion 9 (9B) is positioned between the third leg portion 2 (2C) and the fourth leg portion 2 (2D).

The spring plate 50 according to the fifth embodiment includes more support leg portions 9 than the spring plate 40. The third support leg portion 9 (9C) is positioned between the first leg portion 2 (2A) and the fourth leg portion 2 (2D). The fourth support leg portion 9 (9D) is positioned between the second leg portion 2 (2B) and the third leg portion 2 (2C).

As in FIGS. 4C and 4D, the central portion 1 may include a central opening 7 with an extension, which may be in contact with a first electrode 14 below the central portion 1 of the spring plate 40 or 50. This extension may improve a click feeling of a user when a push switch including the spring plate 40 or 50 is pressed down by the user. The spring plate 40 or 50 may include openings 8 through the central portion 1 of the spring plate 40 or 50 around the central opening 7.

Figure 5A:
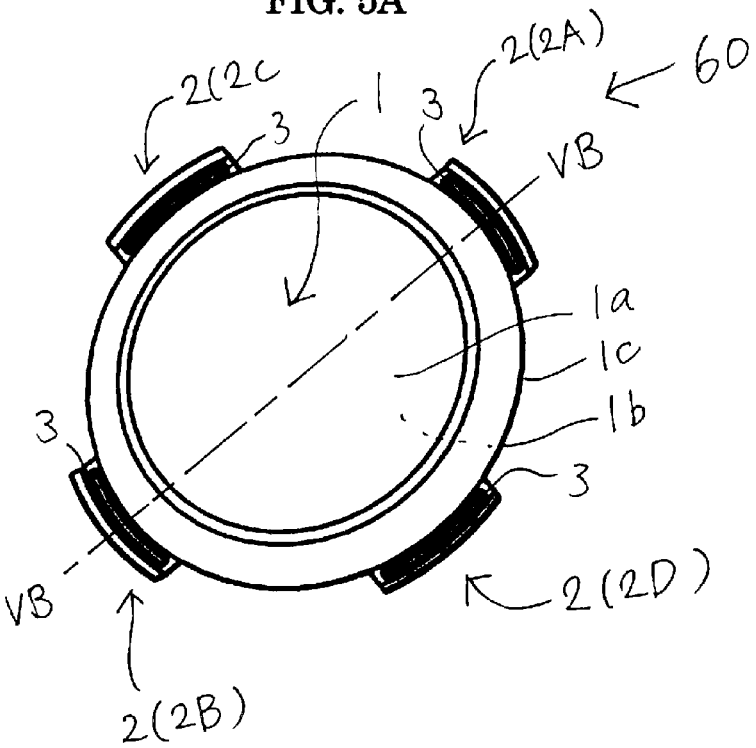
FIG. 5A is a top perspective view of a spring plate according to a sixth embodiment of the subject matter.

FIG. 5A is a top perspective view of a spring plate 60 according to a sixth embodiment of the subject matter. In this embodiment, the spring plate 60 includes a central portion 1 that has a circular shape. Regarding the leg portion 2, descriptions about FIG. 1A-1C may be referred to.

Figure 5B:
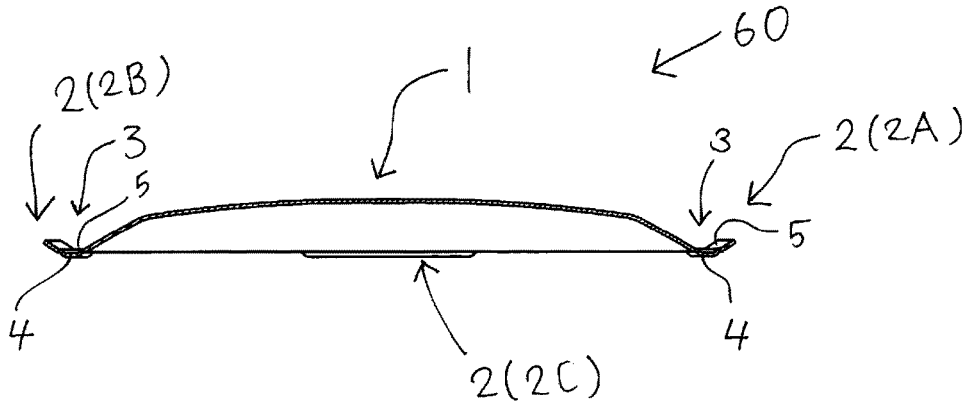
FIG. 5B is a cross-sectional view of the spring plate, taken along a dot and dash line VB of FIG. 5A.

FIG. 5B is a cross-sectional view of a spring plate 60, taken along a dot and dash line VB of FIG. 5A.

Figure 6A:
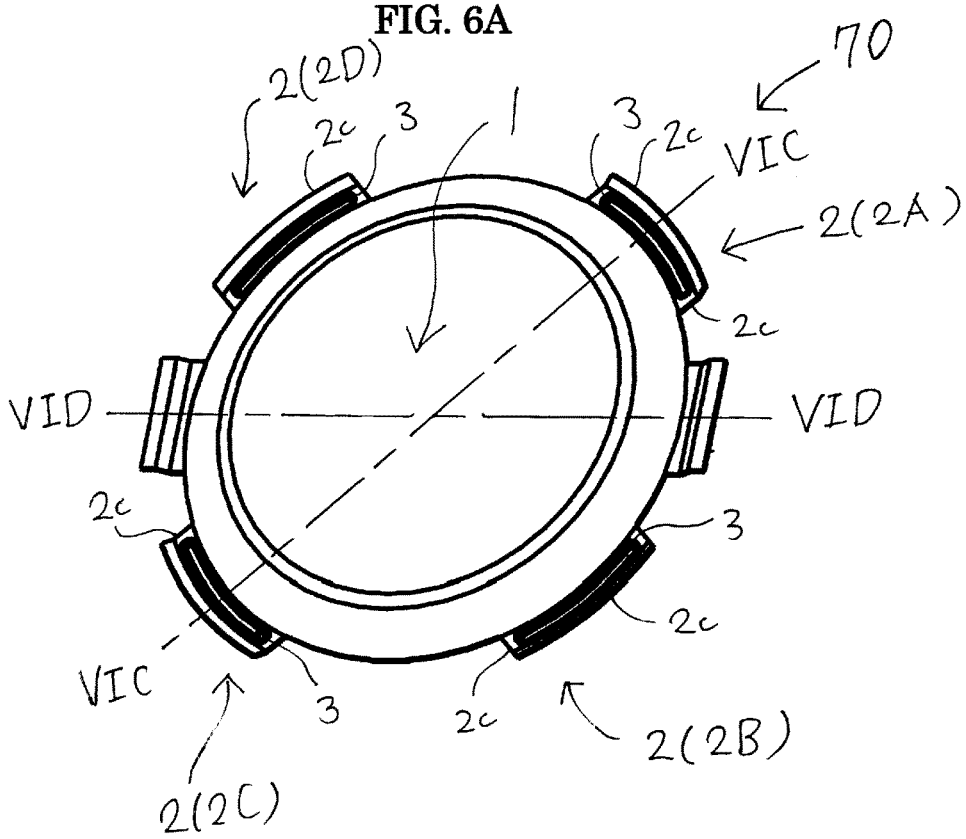
FIG. 6A is a top perspective view of a spring plate according to a seventh embodiment of the subject matter.

FIG. 6A is a top perspective view of a spring plate 70 according to a seventh embodiment of the subject matter.

Figure 6B:
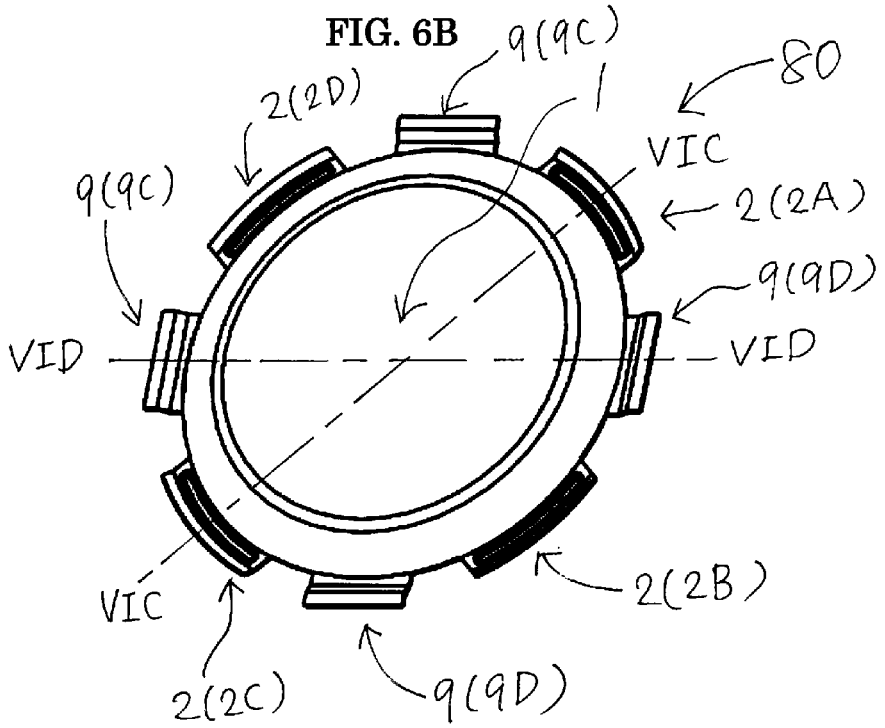
FIG. 6B is a top perspective view of a spring plate according to an eighth embodiment of the subject matter.

FIG. 6B is a top perspective view of a spring plate 80 according to an eighth embodiment of the subject matter.

Regarding the leg portion 2 and the support leg portion 9, descriptions about FIGS. 4A-4D may be referred to.

Figure 6C:
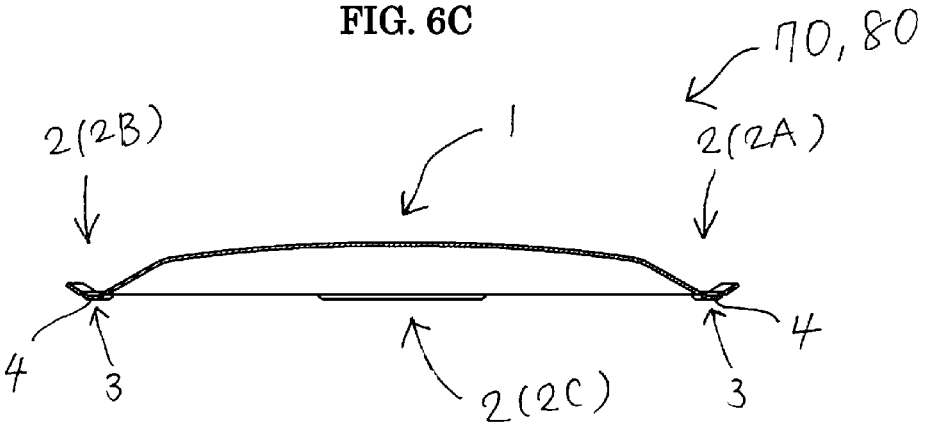
FIG. 6C is a cross-sectional view of the spring plate, taken along a dot and dash line VIC of FIG. 6A or FIG. 6B.

FIG. 6C is a cross-sectional view of the spring plate 70 or 80, taken along a dot and dash line VIC of FIG. 6A or FIG. 6B.

Figure 6D:
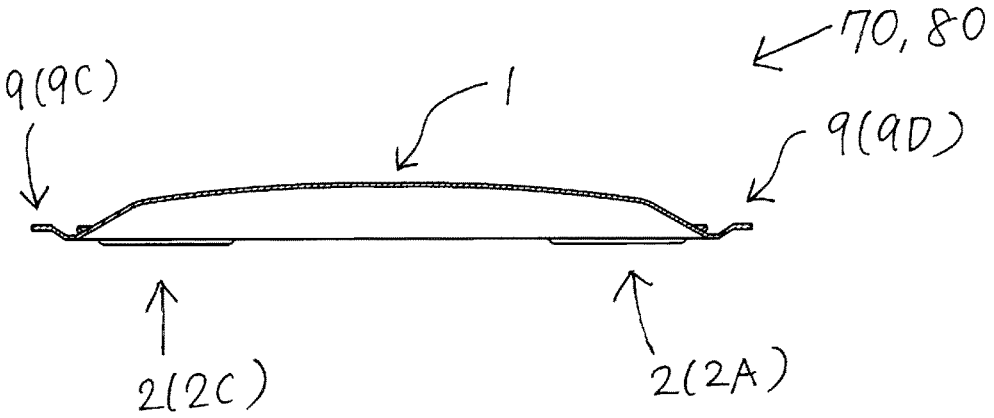
FIG. 6D is a cross-sectional view of the spring plate, taken along a dot and dash line VID crossing across a support leg portion of FIG. 6A or FIG. 6B.

FIG. 6D is a cross-sectional view of the spring plate 70 or 80, taken along a dot and dash line VID crossing across a support leg portion of FIG. 6A or 6B.

Figure 7A:
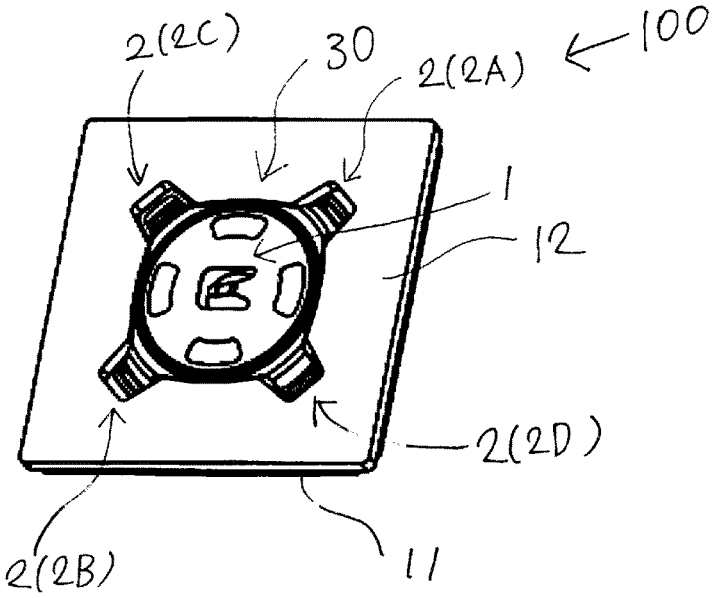
FIG. 7A is a top perspective view of a push switch according to a ninth embodiment of the subject matter.
Figure 7B:
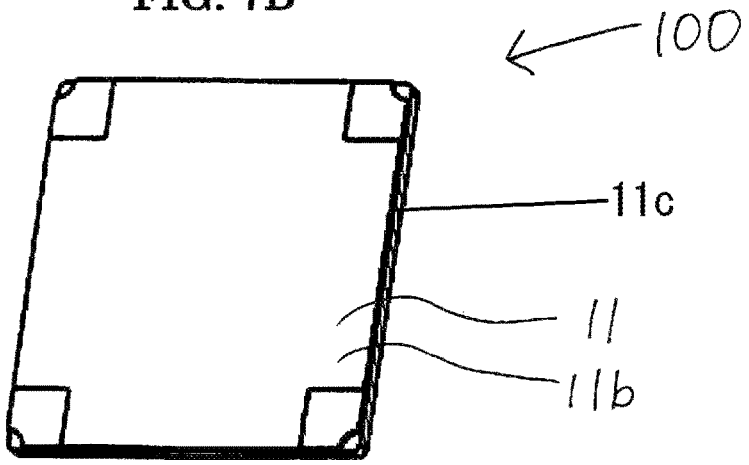
FIG. 7B is a bottom perspective view of the push switch of FIG. 7A.
Figure 7C:
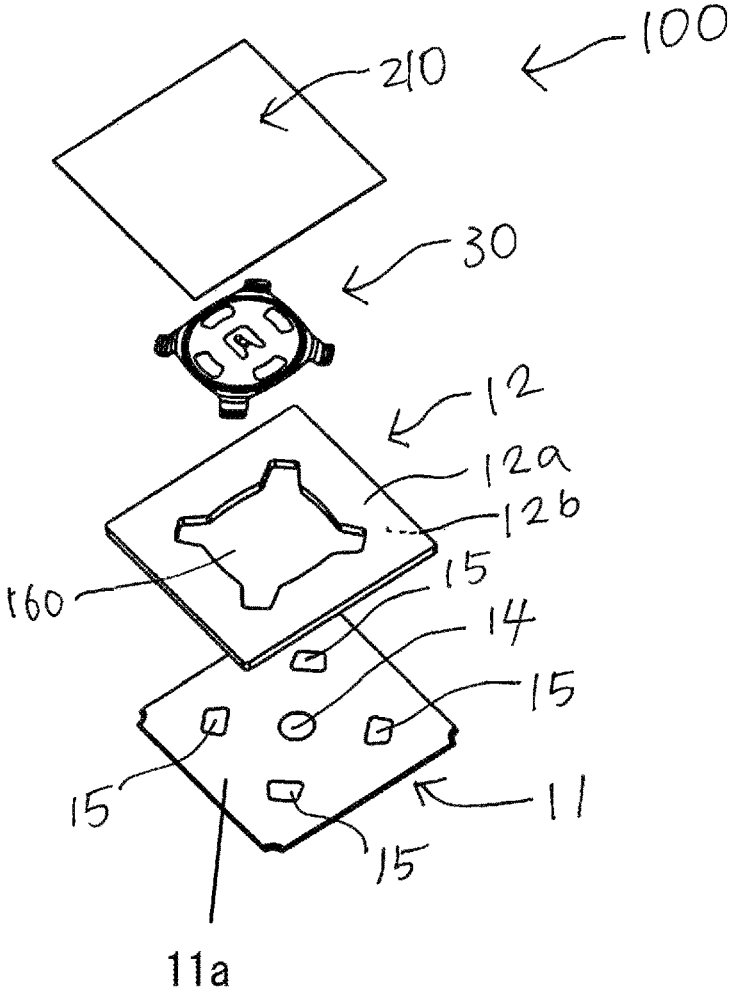
FIG. 7C is an explosive perspective view of the push switch of FIG. 7A. The push switch may further include a sheet covering the spring plate.

A push switch 100 according to a ninth embodiment of the subject matter will be described with reference to FIGS. 7A to 7C.

The push switch according to this embodiment may further include a sheet covering the spring plate. The push switch 100 includes a spring plate 30. As in FIGS. 3A and 3B, the spring plate 30 includes a central portion 1, a leg portion 2 projecting outward from an edge 1*c* of the central portion 1. The leg portion 2 includes a hollow portion 3 that is positioned within an outline 2*c* of the leg portion 2 in a top plan view. The push switch 100 further includes a first electrode 14 arranged below the central portion 1 of the spring plate 30, and a second electrode 15 on which the hollow portion 3 of the leg portion 2 of the spring plate 30 is arranged. The spring plate 30 according to this embodiment may have two or more leg portions 2.

In this embodiment, the push switch 100 includes a substrate 11 including the first electrode 14 and the second electrode 15, which is positioned outside a position of the first electrode 14. The term "substrate" herein may include a resin body has a plate shape, a resin body including a sunken portion in the resin body, and/or a resin body including metal leads. Also, the term "substrate" herein may include a flexible printed circuit board. Also, the term "substrate" herein may be a motherboard, which belongs to an electronic device. A substrate may belong to a push switch and/or to an electronic device.

For more details, the push switch 100 includes the spring plate 30. As in FIGS. 3A, 3B and 1B the spring plate 30 includes a central portion 1, and a leg portion 2 projecting outward from an edge 1*c* of the central portion 1. The leg portion 2 includes a hollow portion 3 that is positioned within an outline 2*c* of the leg portion 2 in a top plan view. The substrate 11 may include a first surface 11*a*, a second surface 11*b* that is positioned opposite to the first surface 11*a*, a peripheral side surface 11*c* between the first surface 11*a* and the second surface 11*b*. The first electrode 14 is arranged on the first surface 11*a* of the substrate 11, and the second electrode 15 is arranged on the first surface 11*a* of the substrate 11. The hollow portion 3 of the leg portion 2 of the spring plate 30 includes a bottom 4 that includes a first surface 4*a* and a second surface 4*b* opposite to the first surface 4*a* of the bottom 4. The hollow portion 3 further includes a surrounding surface 5 that surrounds the first surface 4*a* of the bottom 4 of the hollow portion 3. The second surface 4*b* of the bottom 4 of the hollow portion 3 is arranged on the second electrode 15 arranged on the first surface 11*a* of the substrate 11. The second surface 4*b* of the bottom 4 of the hollow portion 3 may be a flat surface.

In this embodiment, the push switch 100 further includes a frame 12 that is arranged on the first surface 11*a* of the substrate 11. The frame 12 includes an opening 160 passing through the frame 12 from an upper surface 12*a* to a lower surface 12*b*. The first electrode 14 may be positioned in the opening 160. The second electrode 15 may be positioned in the opening 160 and/or adjacent to an outline of the opening 160. The opening 160 of the frame 12 has a shape to house the spring plate 30. The central portion 1 of the spring plate 30 is arranged over the first electrode 14 and the leg portion 2 is arranged on the second electrode 15. Two or more second electrodes 15 may be arranged around the first electrode 14, and two or more leg portions 2 may be arranged in contact with the two or more second electrodes 15.

Figure 8A:
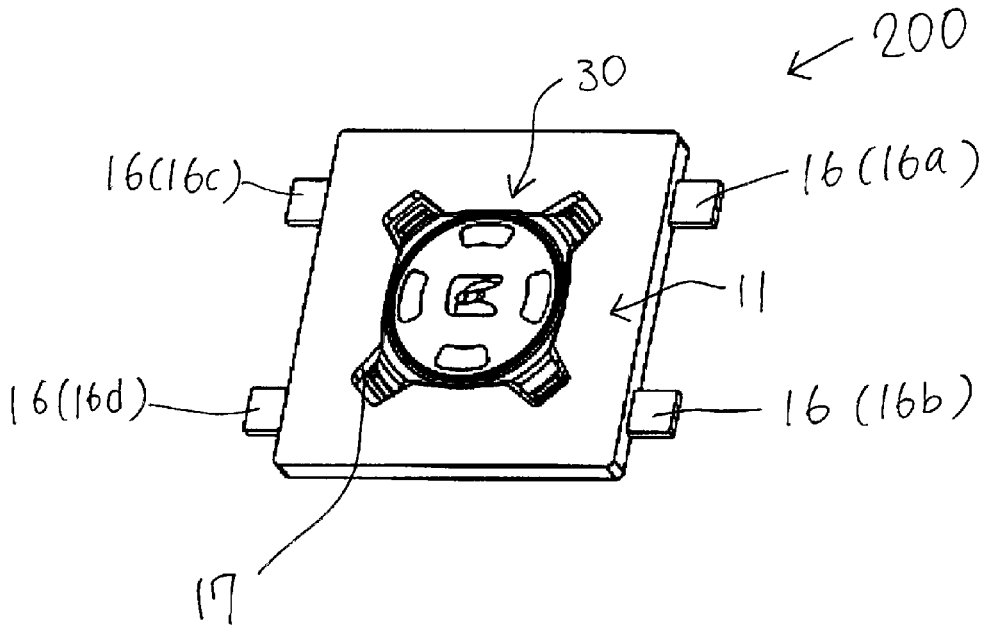
FIG. 8A is a top perspective view of a push switch according to a tenth embodiment of the subject matter.
Figure 8B:
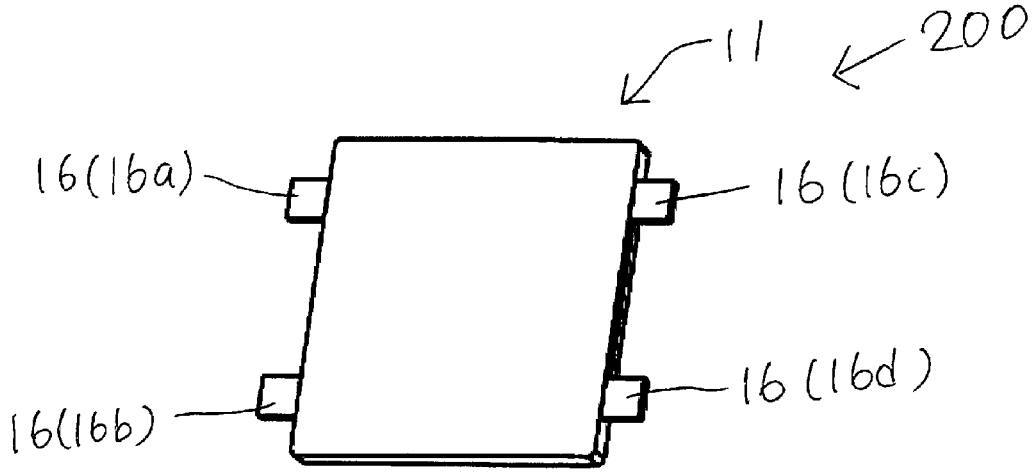
FIG. 8B is a bottom perspective view of the push switch of FIG. 8A.
Figure 8C:
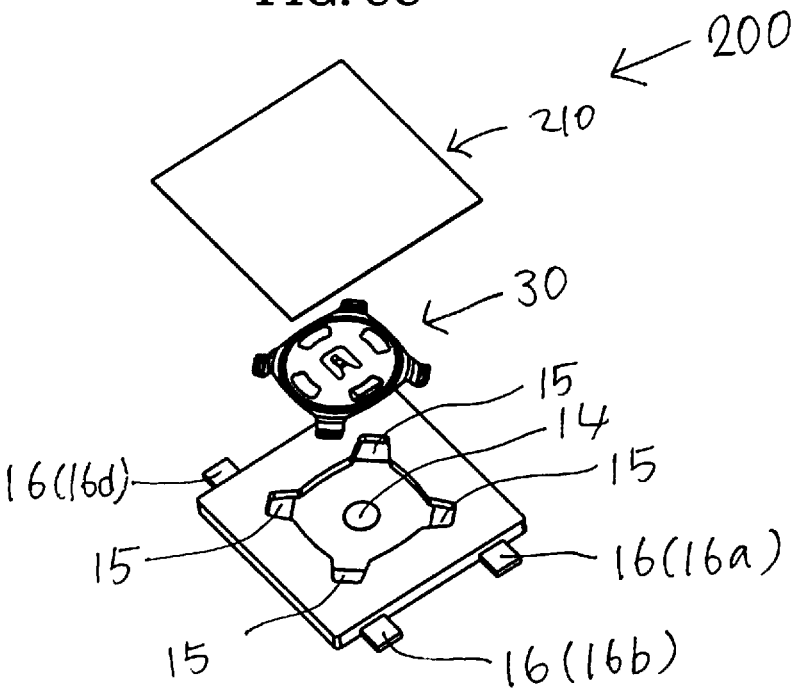
FIG. 8C is an explosive perspective view of the push switch of FIG. 8A. The push switch further includes a sheet covering the spring plate.

A push switch 200 according to a tenth embodiment of the subject matter will be described with reference to FIGS. 8A to 8C.

In this embodiment, the push switch 200 includes a substrate 11 comprising at least two metal leads 16 that are partly embedded in the substrate 11. In this embodiment, the substrate 11 may be a resin body including metal leads 16 (16*a*, 16*b*, 16*c*, and 16*d*). The substrate 11 may include a sunken portion 17 in which the spring plate 30 is arranged.

The metal leads 16 may be used to electrically connect the push switch 200 to a substrate, which may belong to an electronic device. Also, the metal leads 16 may be used to fix the push switch 200 on the substrate of the electronic device.

In this embodiment, the substrate 11 includes a first electrode 14 arranged at a center in the sunken portion 17 of the substrate 11. The substrate 11 further includes a second electrode 15 that is positioned adjacent to a periphery in the sunken portion 17 of the substrate 11. The second electrode 15 may be arranged to surround the first electrode 14. The at least two metal leads 16 may include a first metal lead 16*a*, a second metal lead 16*b*, a third metal lead 16*c*, and a fourth metal lead 16*d*. The first electrode 14 may be electrically connected to the first metal lead 16*a*, for example. The second electrode 15 may be electrically connected to the second metal lead 16*b*, for example. The metal leads 16 may be used for the push switch 200 being electrically and/or physically connected to electrodes arranged on a flexible printed circuit board of an electronic device, for example.

The push switch 200 may include a sheet 210 that covers the spring plate 30. The sheet 210 may be arranged on the substrate 11 to cover the spring plate 30. The sheet 210 may be arranged to prevent a foreign substance from entering inside the push switch 200. The push switch 200 may further include a pressing member 62 on which a pressing force may be directly applied from above the push switch in FIGS. 15A and 15B, for example.

Figure 9A:
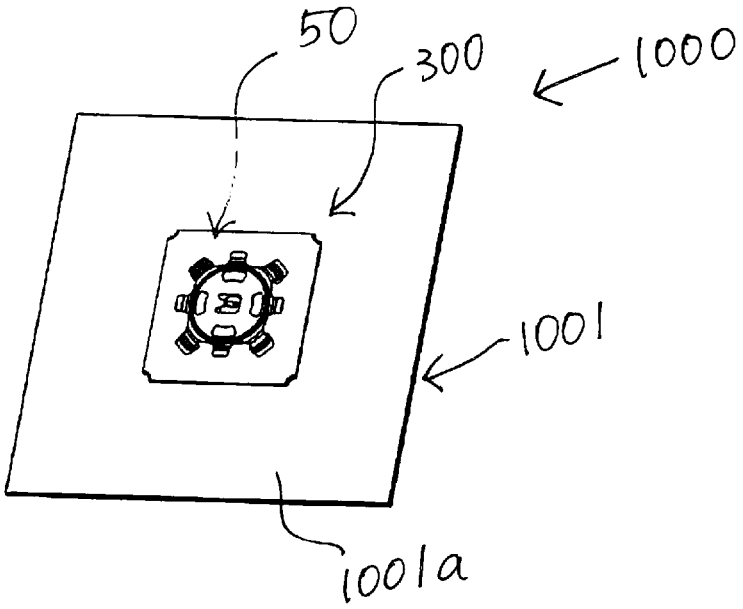
FIG. 9A is a top perspective view of a push switch according to an eleventh embodiment of the subject matter. In this embodiment the push switch is electrically mounted on a surface of a motherboard, which may belong to an electronic device.
Figure 9B:
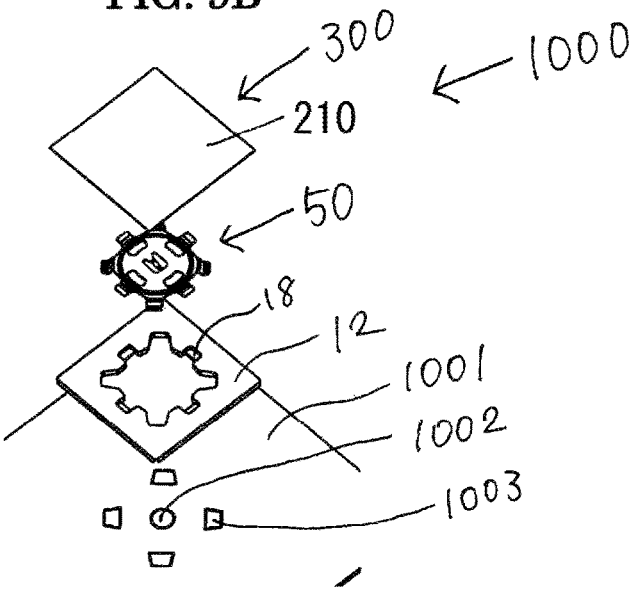
FIG. 9B is an explosive perspective view of the push switch of FIG. 9A.
Figure 9C:
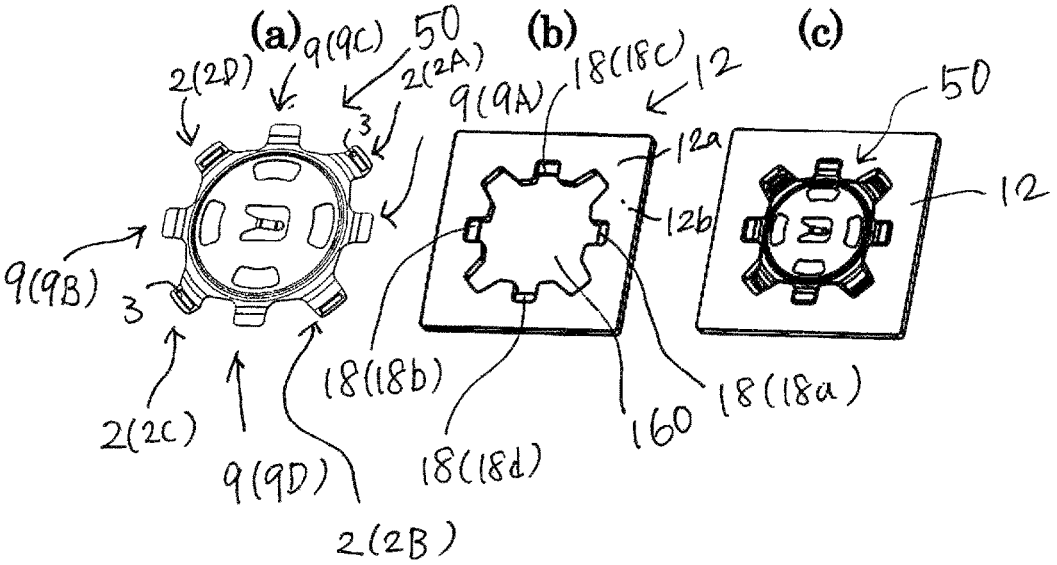
FIG. 9C (a) is a perspective view of a spring plate according to the eleventh embodiment of the subject matter.

A push switch 300 according to an eleventh embodiment of the subject matter will be described with reference to FIGS. 9A to 9C.

In this embodiment the push switch 300 includes a spring plate 50 and a frame 12 and is electrically mounted on a surface 1001*a* of a motherboard 1001, which may belong to an electronic device 1000.

In this embodiment, the frame 12 includes an opening 160 passing through the frame 12 from an upper surface 12*a* to a lower surface 12*b*. The frame 12 in this embodiment further includes a support 18 that may support a support leg portion 9 of the spring plate 50 arranged in the opening 160. The support 18 may be positioned adjacent to a periphery of the opening 160.

The frame 12 in which the spring plate 50 is set may be a switch part. The switch part may be directly mounted on a substrate, which belongs to an electronic device.

The electronic device 1000 may include the motherboard 1001. The motherboard 1001 may include a first surface 1001*a*, a first electrode 1002 arranged on the first surface 1001*a*, and a second electrode 1003 arranged outside a position of the first electrode 1002.

The switch 300 may include the spring plate 50. As in FIG. 4B, the spring plate 50 includes a central portion 1, a first leg portion 2 (2A) projecting outward from an edge 1*c* of the central portion 1, a second leg portion 2 (2B) projecting outward from the edge 1*c* of the central portion 1, a third leg portion 2 (2C) projecting outward from the edge 1*c* of the central portion 1, and a fourth leg portion 2 (2D) projecting outward from the edge 1*c* of the central portion 1. The spring plate 50 may further include four support leg portions 9 projecting outward from the edge 1*c* of the central portion 1 and being positioned between at least two of the first leg portion 2 (2A), the second leg portion 2 (2B), the third leg portion 2 (2C) and the fourth leg portion 2 (2D).

The push switch 300 further includes the frame 12 that includes the opening 160 passing through the frame 12 from the upper surface 12*a* to the lower surface 12*b*. The frame 12 further includes the supports 18 that support the support leg portions 9 arranged in the opening 160. The frame 12 in this embodiment includes a first support 18 (18*a*) that supports the first support leg portion 9 (9A), a second support 18 (18*b*) that supports the second support leg portion 9 (9B), a third support 18 (18*c*) that supports the third support leg portion 9 (9C), and a fourth support 18 (18*d*) that supports the fourth support leg portion 9 (9D).

Figure 10A:
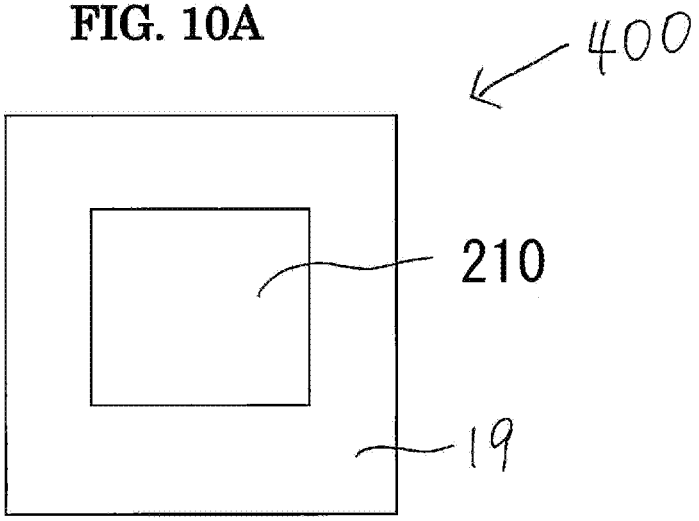
FIG. 10A is a top plan view of a push switch according to a twelfth embodiment of the subject matter.
Figure 10B:
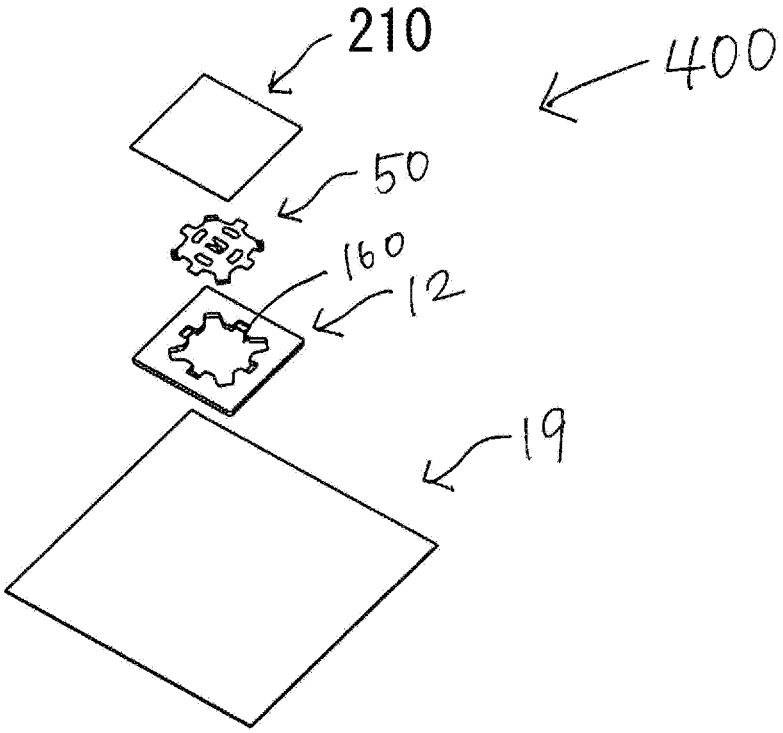
FIG. 10B is an explosive perspective view of the push switch according to the twelfth embodiment of the subject matter.

A push switch 400 according to an twelfth embodiment of the subject matter will be described with reference to FIGS. 10A to 10C.

Figure 10C:
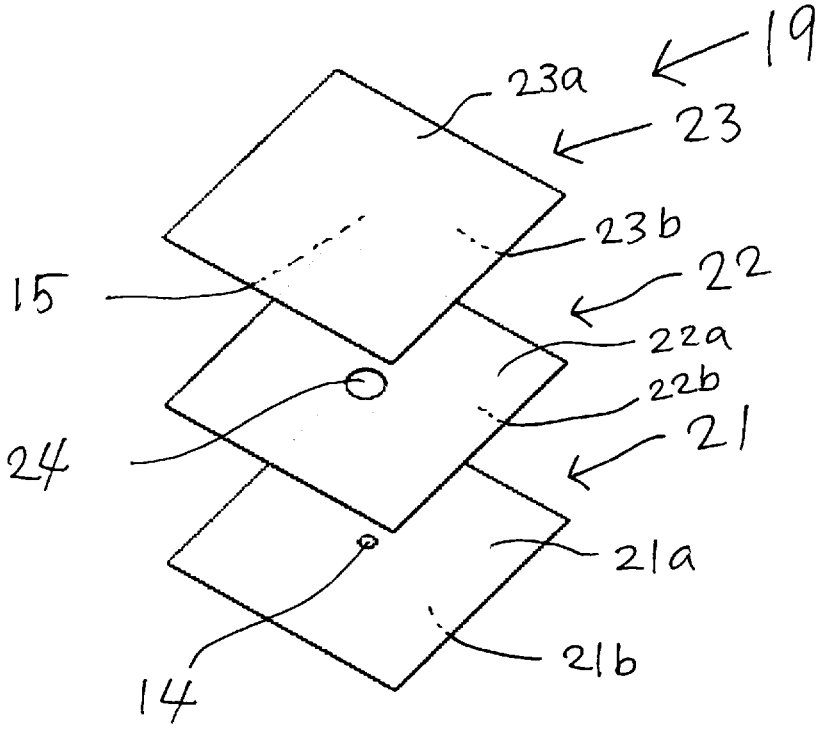
FIG. 10C is an explosive perspective view of a film according to the twelfth embodiment of the subject matter. The film including a first layer with an upper electrode, a second layer with a hole, and a third layer with a lower electrode.

As in FIG. 10C, a film 19 may include a first layer 21 with a first electrode 14, a second layer 22 with a hole 24, and a third layer 23 with a lower electrode 15.

Figure 4B:
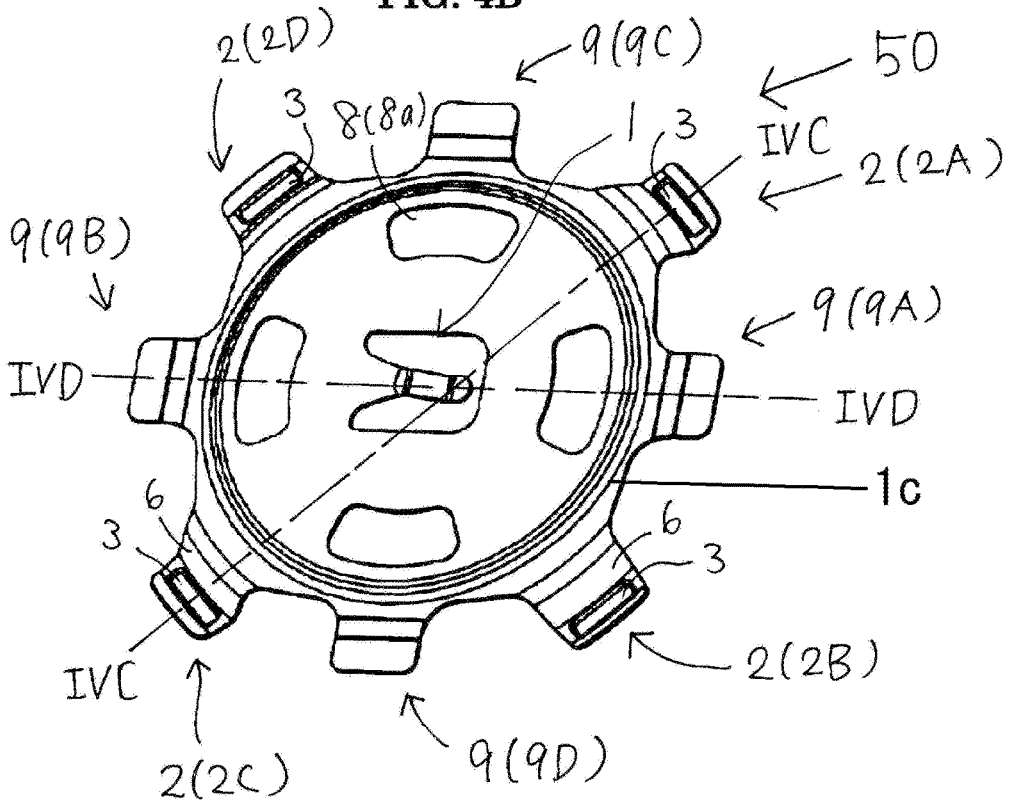
FIG. 4B is a top perspective view of a spring plate according to a fifth embodiment of the subject matter. The spring plate includes four support leg portions.
Figure 4C:
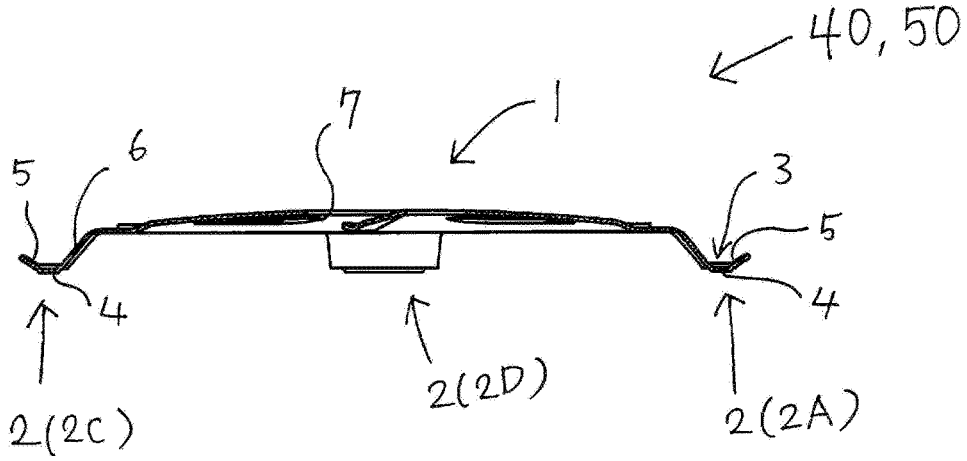
FIG. 4C is a cross-sectional view of the spring plate, taken along a dot and dash line IVC of FIG. 4A or FIG. 4B.
Figure 4D:
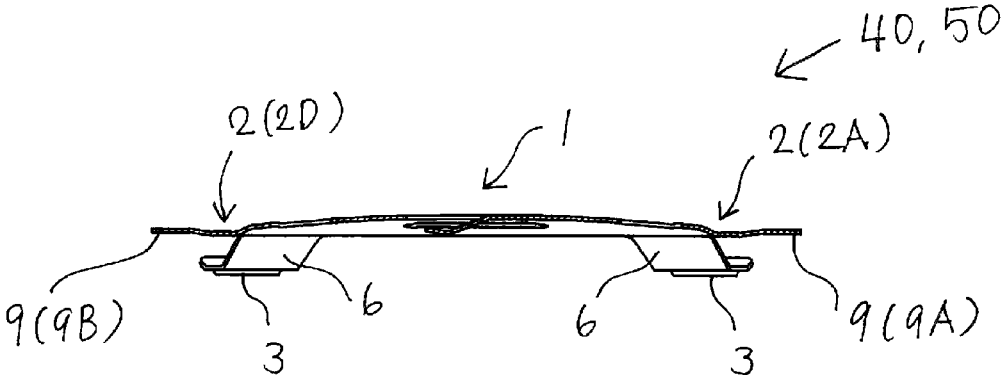
FIG. 4D is a cross-sectional view of the spring plate, taken along a dot and dash line IVD of FIG. 4A or FIG. 4B.

The push switch 400 includes a spring plate 50 of FIG. 4B and the film 19 of FIG. 10C. The film 19 includes the first layer 21 that includes an upper surface 21*a* and a lower surface 21*b* opposite to the upper surface 21*a*, the second layer 22 that includes an upper surface 22*a* and a lower surface 22*b* opposite to the upper surface 22*a*, and the third layer 23 that includes an upper surface 23*a* and a lower surface 23*b* opposite to the upper surface 23*a*.

The first layer 21 of the film 19 includes the first electrode 14 arranged on the upper surface 21*a* of the first layer 21. The second layer 22 of the film 19 includes the hole 24 passing through the second layer 22 from the upper surface 22*a* to the lower surface 22*b* of the second layer 22. The third layer 23 of the film 19 includes the second electrode 15 arranged on the lower surface 23*b* of the third layer 23. The second electrode 15 arranged on the lower surface 23*b* of the third layer 23 of the film 19, the hole 24 of the second layer 22 of the film 19, and the first electrode 14 arranged on the upper surface 21*a* of the first layer 21 are positioned below the central portion 1 of the spring plate 50.

In this embodiment, the hollow portions 3 of the leg portions 2 of the spring plate 50 are arranged in contact with the film 19. The second surface 4*b* of the bottom 4 of the hollow portion 3 is arranged on the film 19. The second surface 4*b* of the bottom 4 of the hollow portion 3 may be a flat surface. The shape of the hollow portion 3 at the leg portion 2 of the spring plate 50 according to this embodiment of the subject matter may give less impair a surface quality of the film 19, compared to a shape including and/or connected to a part of a cross section of a spring plate, for example. The spring plate may be cut out from a metal plate. If the part of cross section of the spring plate is rubbed on the film 19, bits of the film 19 may occur. However, in this embodiment, since the hollow portion at the leg portion of the spring plate is positioned within the outline of the spring plate, the lower surface 4*b* of the bottom 4 of the hollow portion on the second electrode is free from a cross section of the spring plate.

Figure 11A:
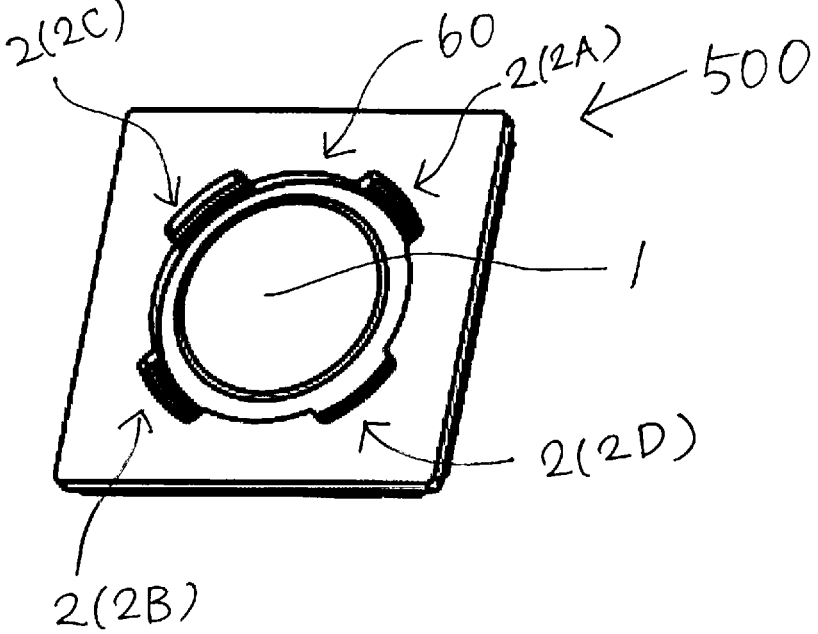
FIG. 11A is a top perspective view of a push switch according to a thirteenth embodiment of the subject matter.
Figure 11B:
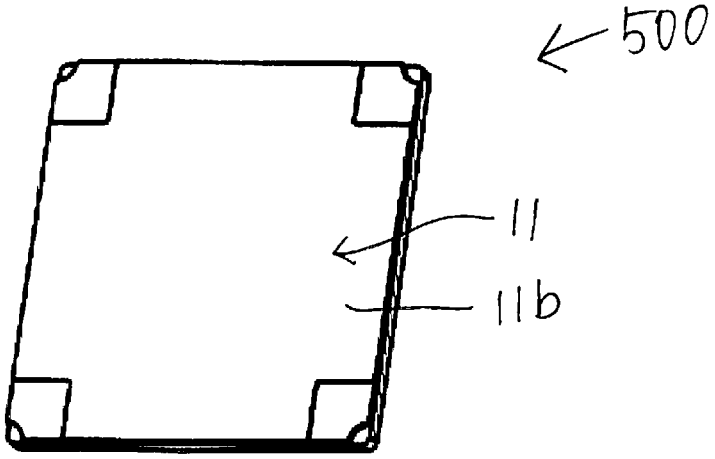
FIG. 11B is a bottom perspective view of the push switch of FIG. 11A.
Figure 11C:
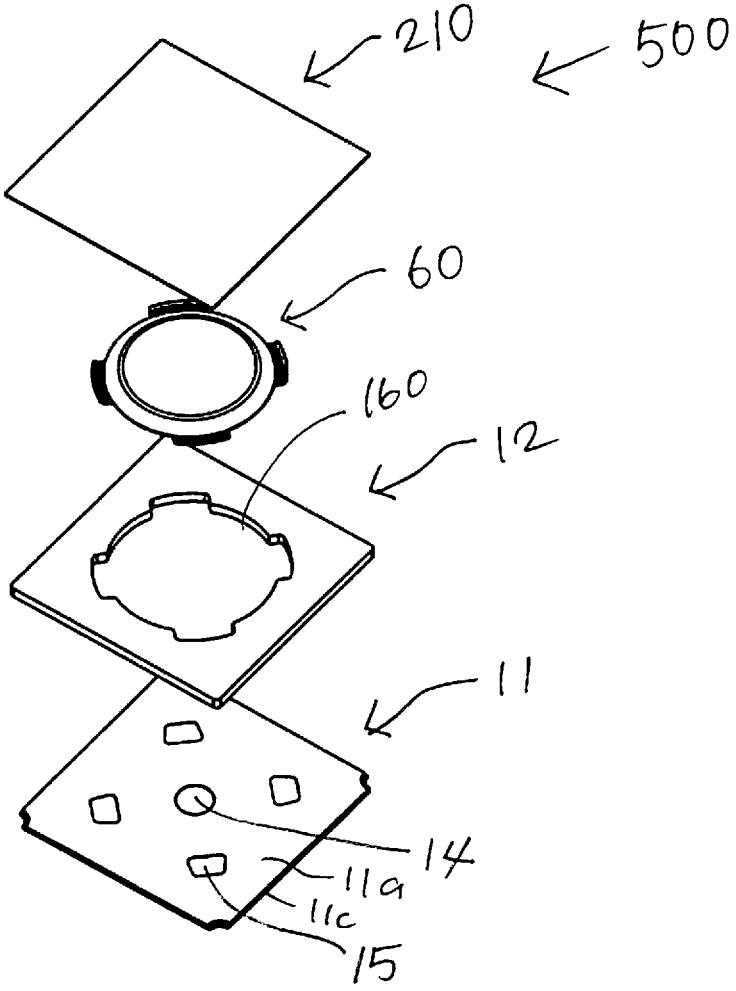
FIG. 11C is an explosive perspective view of the push switch according to the thirteenth embodiment. The push switch further includes a sheet covering the spring plate.

A push switch 500 according to the thirteenth embodiment of the subject matter will be described with reference to FIGS. 11A to 11C.

The push switch 500 further includes a sheet 210 covering a spring plate 60. In this embodiment, as in FIGS. 6A and 6B, the spring plate 60 has a central portion 1 that has a circular shape in a top plan view. A substrate 11 may include a first electrode 14 and a second electrode 15 that are arranged on an upper surface 11*a* of the substrate 11. The substrate 11 may include a through-hole in the substrate 11. The substrate 11 may include a ¼ through hole at a corner of the substrate 11. The through-hole and/or the ¼ through-hole may be electrically connected to the first electrode 14 and/or the second electrode 15.

Figure 12A:
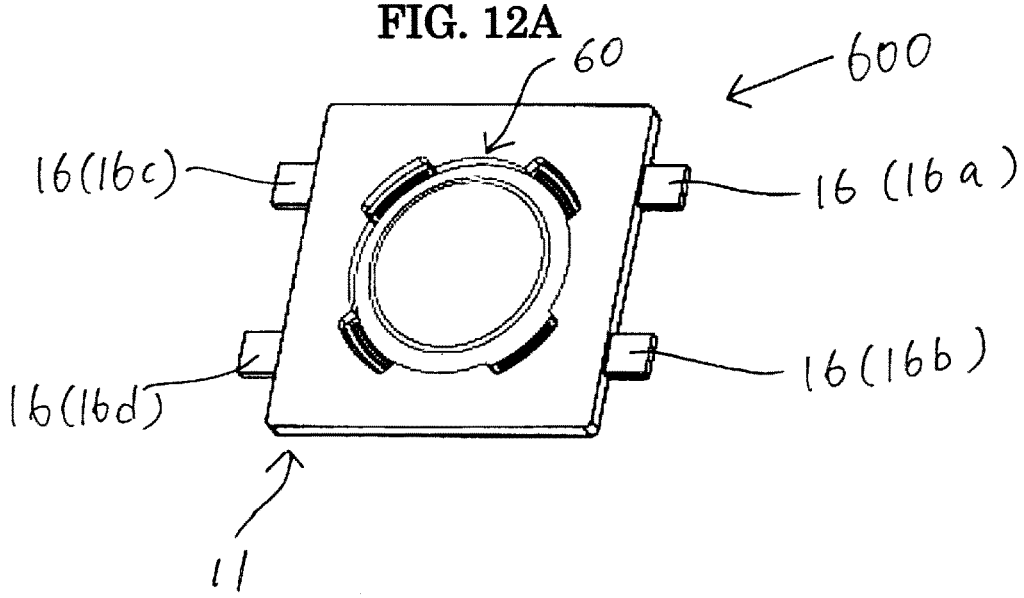
FIG. 12A is a top perspective view of a push switch according to a fourteenth embodiment of the subject matter.
Figure 12B:
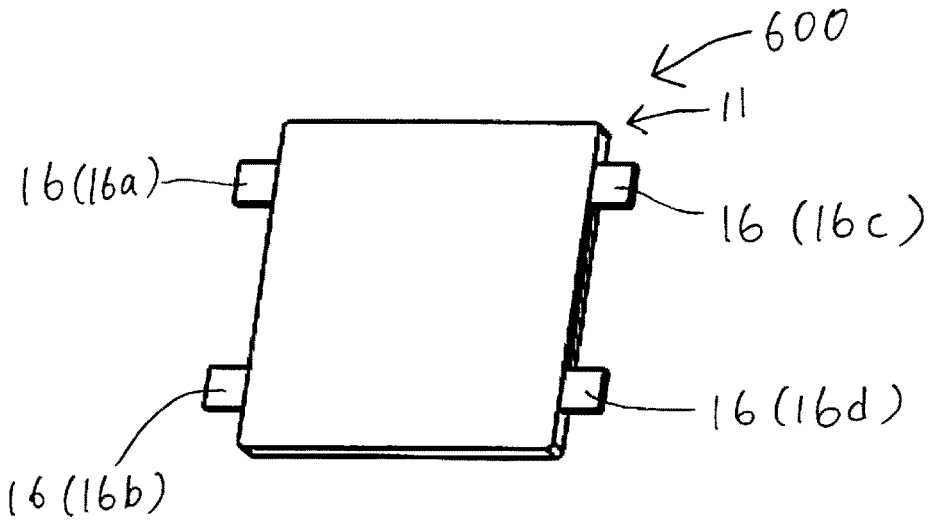
FIG. 12B is a bottom perspective view of the push switch of FIG. 12A.
Figure 12C:
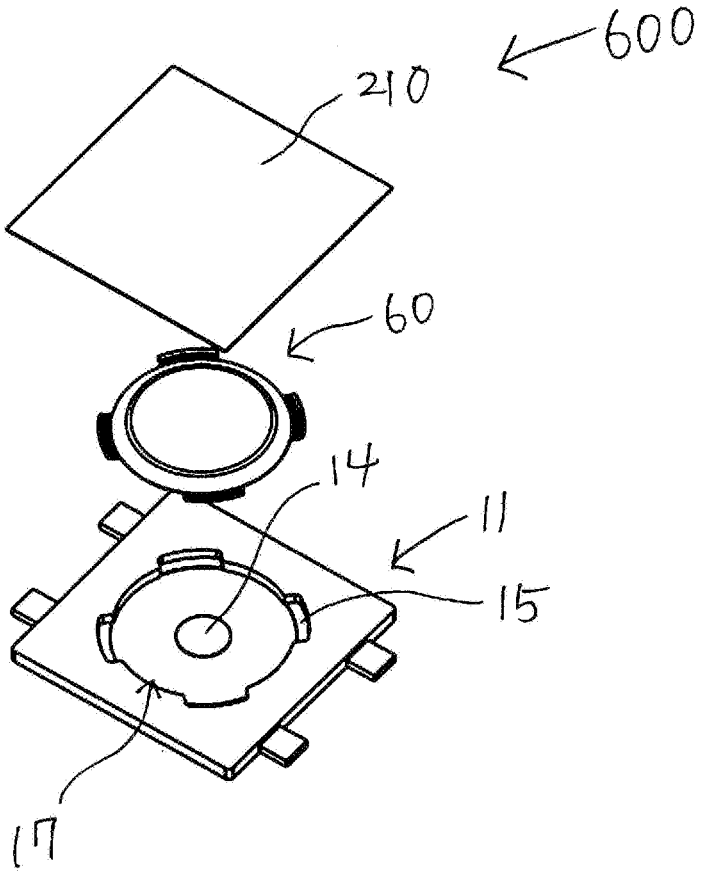
FIG. 12C is an explosive perspective view of the push switch of FIG. 12A.
Figure 13A:
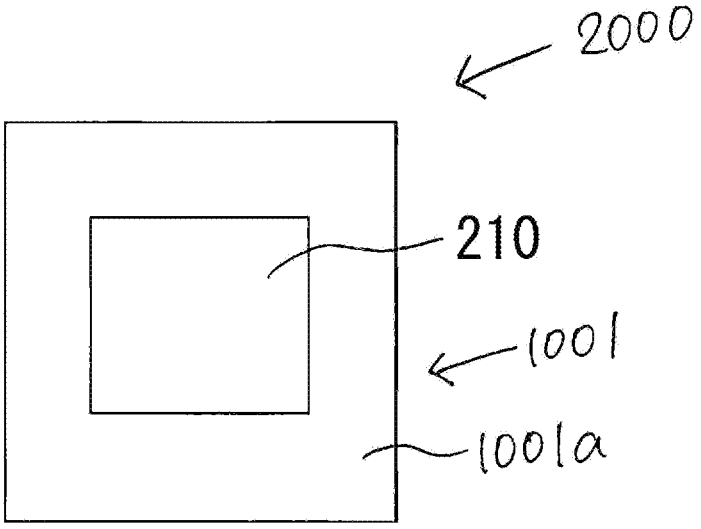
FIG. 13A is a top perspective view of a push switch with a sheet according to a fifteenth embodiment of the subject matter.
Figure 13B:
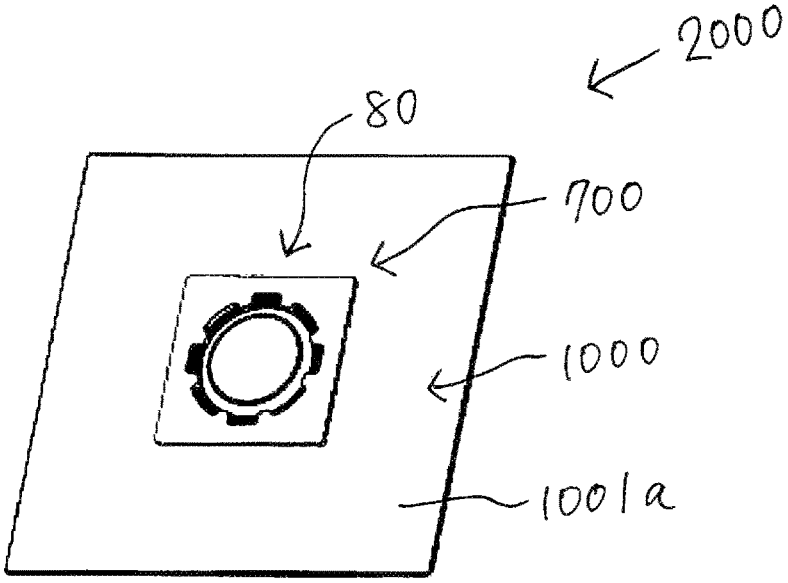
FIG. 13B is a perspective view of the push switch of FIG. 13A without the sheet.
Figure 13C:
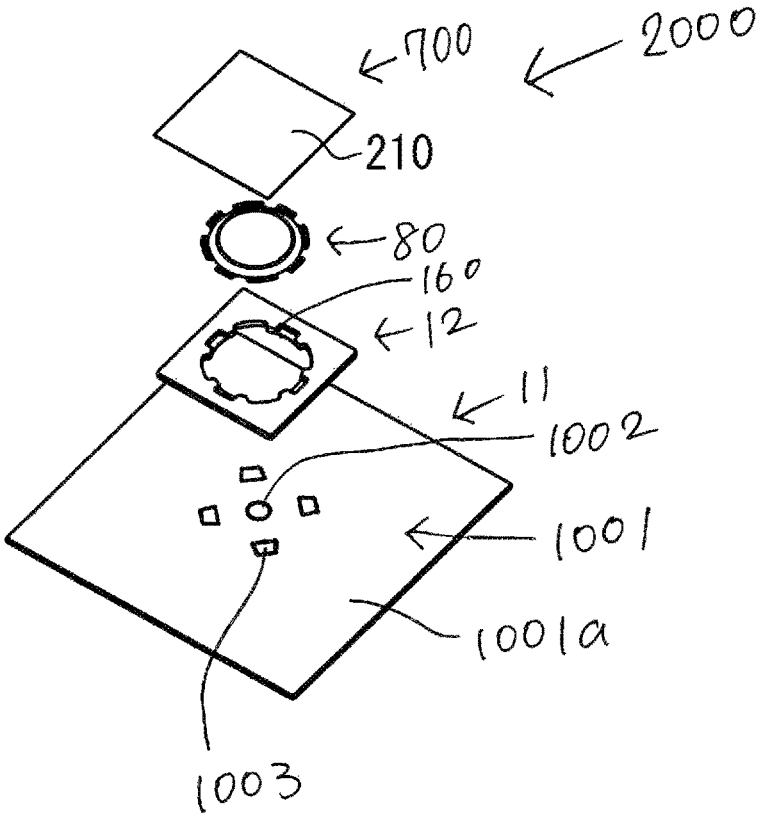
FIG. 13C is an explosive perspective view of the push switch of FIG. 13A.
Figure 13D:
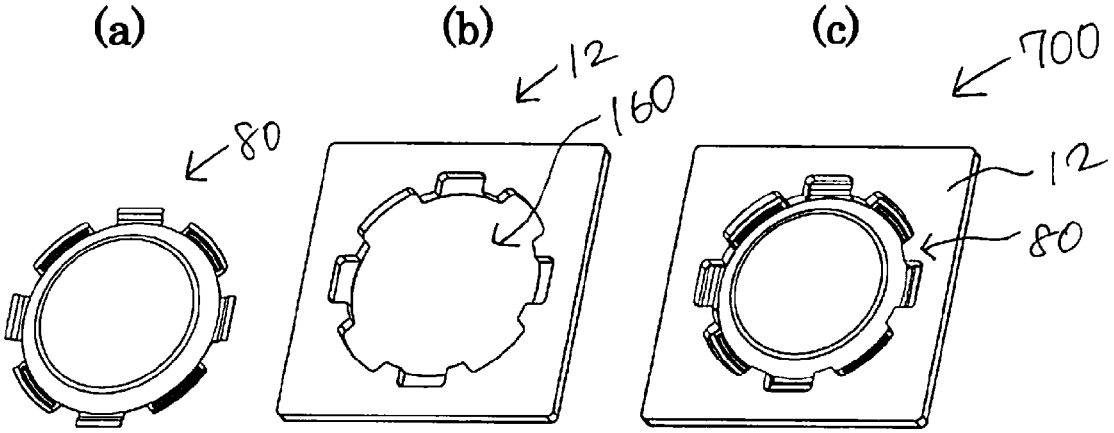
FIG. 13D (a) is a perspective view of a spring plate according to the fifteenth embodiment of the subject matter.

A push switch 600 according to a fourteenth embodiment of the subject matter will be described with refer to FIGS. 12A to 12C.

A substrate 11 in this embodiment is a resin body including a sunken portion 17 in the resin body. The resin body may include metal leads 16 (16*a*, 16*b*, 16*c*, 16*d*).

A push switch 700 of a fifteenth embodiment of the subject matter will be described with to FIGS. 13A to 13D.

In this embodiment, the push switch 700 includes a spring plate 80 and a frame 12. And the push switch 700 is electrically mounted on a surface 1001*a* of a motherboard 1001, which may belong to an electronic device 2000. The electronic device 2000 may include the motherboard 1001. The motherboard 1001 may include a first surface 1001*a*, a first electrode 1002 arranged on the first surface 1001*a*, and a second electrode 1003 arranged outside a position of the first electrode 1002.

In this embodiment, a sheet 210 may cover the push switch 700. The frame 12 includes an opening 160 in which the spring plate 80 is set.

Figure 14A:
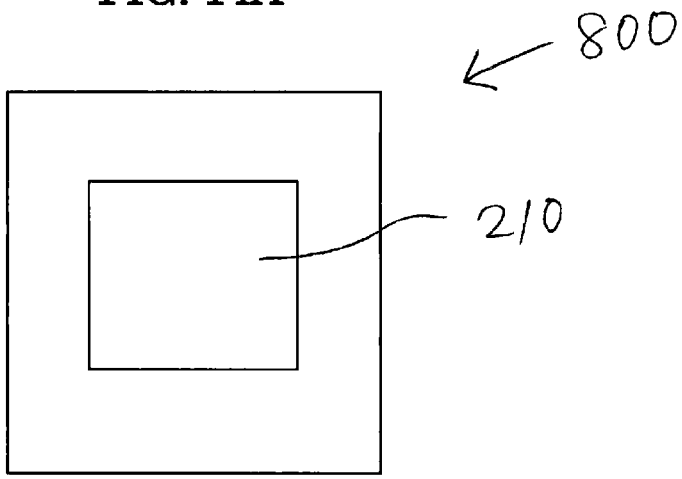
FIG. 14A is a top perspective view of a push switch according to a sixteenth embodiment of the subject matter.

FIG. 14A is a top perspective view of a push switch 800 according to a sixteenth embodiment of the subject matter.

Figure 14B:
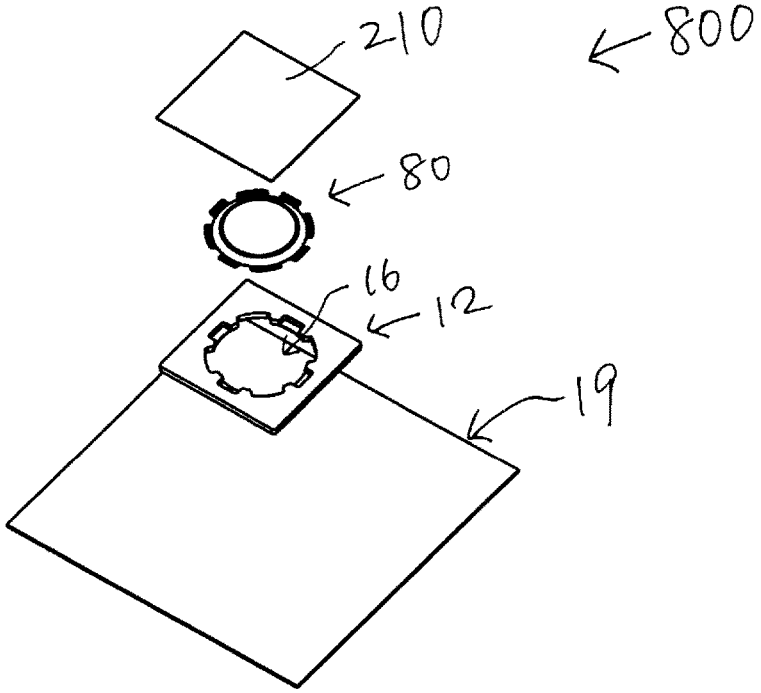
FIG. 14B is an explosive perspective view of the push switch of FIG. 14A.

FIG. 14B is an explosive perspective view of a push switch 800 of FIG. 14A. The push switch 800 includes a spring plate 80, and a film 19. The film 19 includes a first layer 21 that includes an upper surface 21*a* and a lower surface 21*b* opposite to the upper surface 21*a*, a second layer 22 that includes an upper surface 22*a* and a lower surface 22*b* opposite to the upper surface 22*a*, and a third layer 23 that includes an upper surface 23*a* and a lower surface 23*b* opposite to the upper surface 23*a*. The first layer 21 of the film 19 includes a first electrode 14 arranged on the upper surface 21*b* of the first layer 21. The second layer 22 of the film 19 includes a hole 24 passing through the second layer 22 from the upper surface 22*a* to the lower surface 22*b* of the second layer 22. The third layer 23 of the film 19 includes a second electrode 15 arranged on the lower surface 23*b* of the third layer 23.

The second electrode 15 arranged on the lower surface 23*b* of the third layer 23 of the film 19, the hole 24 of the second layer 22 of the film 19, and the first electrode 14 arranged on the upper surface 21*a* of the first layer 21 are positioned below the central portion 1 of the spring plate 40. The film 19 is shown in FIG. 10C.

Figure 15A:
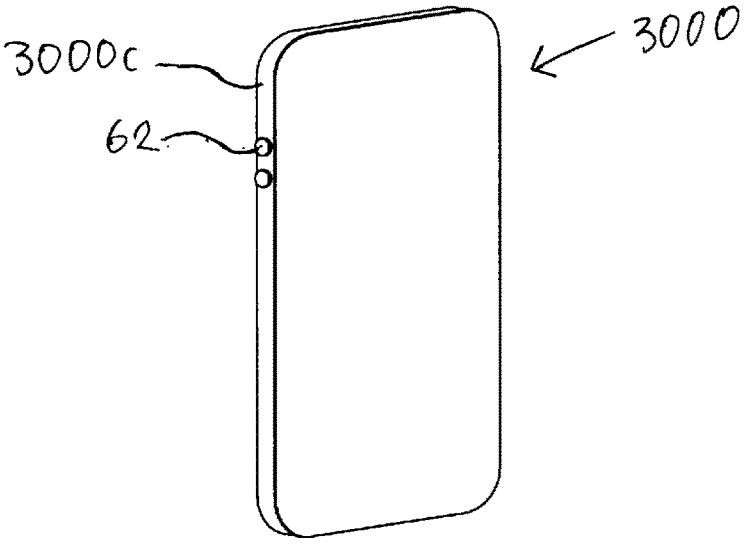
FIG. 15A is a perspective view of an electronic device including a switch according to an embodiment of the subject matter.

FIG. 15A is an electronic device including a switch according to an embodiment of the subject matter.

Figure 15B:
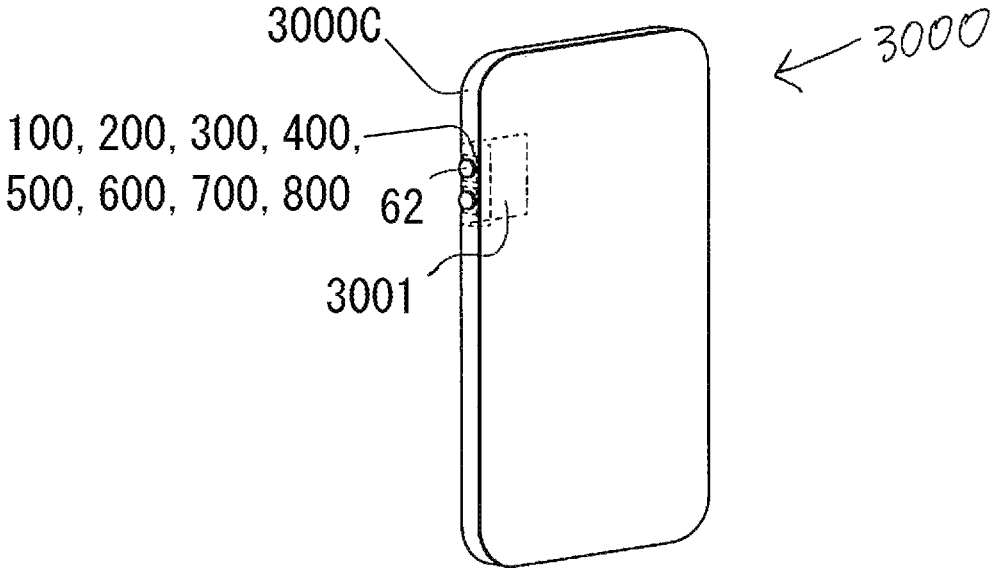
FIG. 15B is a perspective view of the electronic device with a motherboard and a push switch according to an embodiment of the subject matter. The push switch may be mounted on the motherboard that is a flexible printed circuit board.

FIG. 15B is a switch according to an embodiment of the subject matter. The switch may be mounted on a motherboard that is a flexible printed circuit board.

An electronic device 3000 includes a motherboard 3001 and a push switch 100, 200, 300, 400, 500, 600, 700, or 800 according to the subject matter disclosed herein. The motherboard 3001 includes electrodes that may include a first electrode and a second electrode to which the push switch 100, 200, 300, 400, 500, 600, 700, or 800 is electrically connected. The motherboard 3001 may be a flexible printed circuit board. The push switch according to the subject matter may be arranged at a side 3000*c* of the electronic device 3000. The push switch according to the subject matter herein may be arranged horizontally and/or vertically in and/or on an electronic device.

Various electronic devices include push switches. An electronic device includes the push switch according to an embodiment of the subject matter, and a motherboard includes a first electrode and a second electrode. The push switch may be electrically connected to the first electrode and the second electrode of the motherboard of the electronic device.

Furthermore, while certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

What is claimed is:

1. A push switch comprising:

a spring plate comprising a central portion, a leg portion projecting outward from an edge of the central portion, the leg portion comprising a hollow portion, the hollow portion being positioned within an outline of the leg portion in a top plan view and at a lowest position of the spring plate;

a first electrode arranged below the central portion of the spring plate; and a second electrode on which the hollow portion of the leg portion of the spring plate is arranged, wherein the hollow portion has a cup shape and comprises a bottom and a surrounding surface that surrounds the bottom.

2. The push switch according to claim 1, wherein the leg portion includes a slant portion that is positioned closer to the edge of the central portion than the hollow portion.

3. The push switch according to claim 1, further comprising:

a substrate comprising the first electrode and the second electrode, the second electrode being positioned outside a position of the first electrode.

4. A push switch according to claim 3, wherein the substrate further comprises at least two metal leads that are partly embedded in the substrate and a sunken portion in which the plate spring is arranged.

* * * * *